US011073789B2

(12) United States Patent
Sato et al.

(10) Patent No.: US 11,073,789 B2
(45) **Date of Patent: *Jul. 27, 2021**

(54) PROCESS CARTRIDGE INCLUDING A DRUM UNIT AND A TONER CARTRIDGE HAVING A TONER ACCOMMODATION CHAMBER AND A WASTE-TONER ACCOMMODATION CHAMBER

(71) Applicant: BROTHER KOGYO KABUSHIKI KAISHA, Nagoya (JP)

(72) Inventors: Shougo Sato, Seto (JP); Hideshi Nishiyama, Owariasahi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/929,864

(22) Filed: Jul. 15, 2020

(65) Prior Publication Data

US 2020/0348621 A1 Nov. 5, 2020

Related U.S. Application Data

(63) Continuation of application No. 16/525,961, filed on Jul. 30, 2019, now Pat. No. 10,732,566, which is a (Continued)

(30) Foreign Application Priority Data

Jun. 22, 2017 (JP) ..... JP2017-122412

(51) Int. Cl.
*G03G 15/00* (2006.01)
*G03G 21/00* (2006.01)
(Continued)

(52) U.S. Cl.
CPC ..... *G03G 21/1814* (2013.01); *G03G 21/0011* (2013.01); *G03G 21/0064* (2013.01); *G03G 21/105* (2013.01); *G03G 21/12* (2013.01)

(58) Field of Classification Search
CPC ..... G03G 15/0822; G03G 15/0868; G03G 21/10; G03G 21/105; G03G 21/12; G03G 21/1814; G03G 21/1821
(Continued)

(56) References Cited

U.S. PATENT DOCUMENTS 6,882,812 B2 4/2005 Kasahara et al.
7,962,063 B2 6/2011 d'Entrecasteaux
(Continued)

FOREIGN PATENT DOCUMENTS

JP 2001-83792 A 3/2001
JP 2003-66815 A 3/2003
(Continued)

OTHER PUBLICATIONS

Notice of Reasons of Refusal issued in corresponding Japanese Patent Application No. 2017-122412, dated May 11, 2021.

*Primary Examiner* — William J Royer
(74) *Attorney, Agent, or Firm* — Merchant & Gould P.C.

(57) ABSTRACT

A drum cleaner in a drum unit removes toner from a photosensitive drum. A waste-toner conveyance pipe has a waste-toner discharge port and conveys toner removed from the photosensitive drum by the drum cleaner. A toner accommodation chamber accommodates toner to be supplied to a developing roller. A waste-toner accommodation chamber accommodates toner removed from the photosensitive drum. A toner cartridge rotatably moves relative to the drum unit between: a first position at which a waste-toner receiving port is separated from the waste-toner discharge port in a state where the toner cartridge is mounted on the drum unit;
(Continued)

and a second position at which an internal space of the waste-toner accommodation chamber is in communication with an internal space of the waste-toner conveyance pipe through the waste-toner discharge port and the waste-toner receiving port in a state where the toner cartridge is mounted on the drum unit.

8 Claims, 11 Drawing Sheets

Related U.S. Application Data continuation of application No. 16/214,621, filed on Dec. 10, 2018, now Pat. No. 10,401,781, which is a continuation of application No. 15/887,180, filed on Feb. 2, 2018, now Pat. No. 10,175,641.

(51) Int. Cl.

| | |
|---|---|
| ***G03G 21/18*** | (2006.01) |
| ***G03G 21/10*** | (2006.01) |
| ***G03G 21/12*** | (2006.01) |

(58) Field of Classification Search
USPC ..... 399/103, 113, 120, 262, 358, 360
See application file for complete search history.

(56) References Cited

U.S. PATENT DOCUMENTS

| | | | | |
|---|---|---|---|---|
| 8,019,254 | B2 | 9/2011 | Tatsumi et al. | |
| 8,320,797 | B2 | 11/2012 | Inomata et al. | |
| 8,369,745 | B2 | 2/2013 | Sato | |
| 8,934,828 | B2 | 1/2015 | Sato | |
| 10,401,781 | B2 | 9/2019 | Sato et al. | |
| 10,732,566 | B2 * | 8/2020 | Sato et al. ..... | G03G 21/105 |
| 2003/0039484 | A1 | 2/2003 | Naito et al. | |
| 2017/0219965 | A1 | 8/2017 | Sakaya et al. | |

FOREIGN PATENT DOCUMENTS

| | | | |
|---|---|---|---|
| JP | 2007-65271 | A | 3/2007 |
| JP | 2016-75879 | A | 5/2016 |

* cited by examiner

PROCESS CARTRIDGE INCLUDING A DRUM UNIT AND A TONER CARTRIDGE HAVING A TONER ACCOMMODATION CHAMBER AND A WASTE-TONER ACCOMMODATION CHAMBER

CROSS REFERENCE TO RELATED APPLICATIONS

This application is a continuation of U.S. patent application Ser. No. 16/525,961, filed Jul. 30, 2019, now U.S. Pat. No. 10,732,566; which is a continuation of U.S. patent application Ser. No. 16/214,621, filed Dec. 10, 2018, now U.S. Pat. No. 10,401,781; which is a continuation of U.S. patent application Ser. No. 15/887,180, filed Feb. 2, 2018, now U.S. Pat. No. 10,175,641; which further claims priority from Japanese Patent Application No. 2017-122412 filed Jun. 22, 2017. The entire contents of all application are incorporated herein by reference.

TECHNICAL FIELD

This disclosure relates to a process cartridge.

BACKGROUND

Conventionally, a process cartridge that includes a photosensitive unit having a photosensitive member, and a toner cartridge capable of being mounted on the photosensitive unit is known.

The photosensitive unit has a developing section, a cleaner that cleans the photosensitive member, and a waste-toner conveyance pipe. The toner cartridge has a toner accommodation chamber, and a waste-toner accommodation chamber. The toner cartridge linearly approaches the photosensitive unit to be mounted on the photosensitive unit. At this time, the developing section and the toner accommodation chamber are connected, and the waste-toner conveyance pipe and the waste-toner accommodation chamber are connected.

SUMMARY

According to one aspect, this specification discloses a process cartridge. The process cartridge includes a drum unit and a toner cartridge. The drum unit includes a photosensitive drum, a developing roller, a drum cleaner, and a waste-toner conveyance pipe. The drum cleaner is configured to remove toner from the photosensitive drum. The waste-toner conveyance pipe has a waste-toner discharge port and is configured to convey toner removed from the photosensitive drum by the drum cleaner. The toner cartridge is configured to be mounted on the drum unit. The toner cartridge includes a toner accommodation chamber, a waste-toner accommodation chamber, and a waste-toner receiving port. The toner accommodation chamber is configured to accommodate toner to be supplied to the developing roller. The waste-toner accommodation chamber is configured to accommodate toner removed from the photosensitive drum by the drum cleaner. The toner cartridge is configured to rotatably move relative to the drum unit between: a first position at which the waste-toner receiving port is separated from the waste-toner discharge port in a state where the toner cartridge is mounted on the drum unit; and a second position at which an internal space of the waste-toner accommodation chamber is in communication with an internal space of the waste-toner conveyance pipe through the waste-toner discharge port and the waste-toner receiving port in a state where the toner cartridge is mounted on the drum unit.

BRIEF DESCRIPTION OF THE DRAWINGS

Embodiments in accordance with this disclosure will be described in detail with reference to the following figures wherein.

DETAILED DESCRIPTION

In the process cartridge described above, when the toner cartridge is mounted on the photosensitive unit, it is necessary that the waste-toner conveyance pipe and the waste-toner accommodation chamber are connected. Therefore, alignment of the toner cartridge and the photosensitive unit is difficult, and the workability of mounting the toner cartridge on the photosensitive unit deteriorates.

Accordingly, an example of an object of this disclosure is to provide a process cartridge in which a toner cartridge is easily mounted on a drum unit.

1. Outline of Process Cartridge 1

Figure 1A:
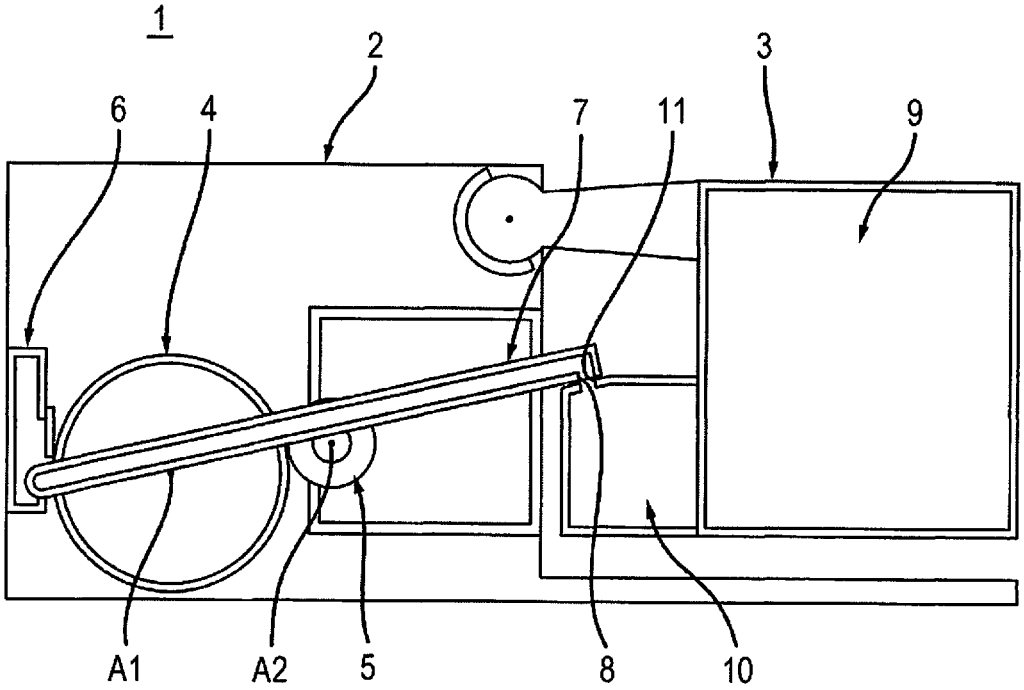
FIG. 1A is an explanatory diagram for schematically explaining a process cartridge of this disclosure and shows a state where a toner cartridge is mounted on a drum unit and the toner cartridge is located at a second position.
Figure 1B:
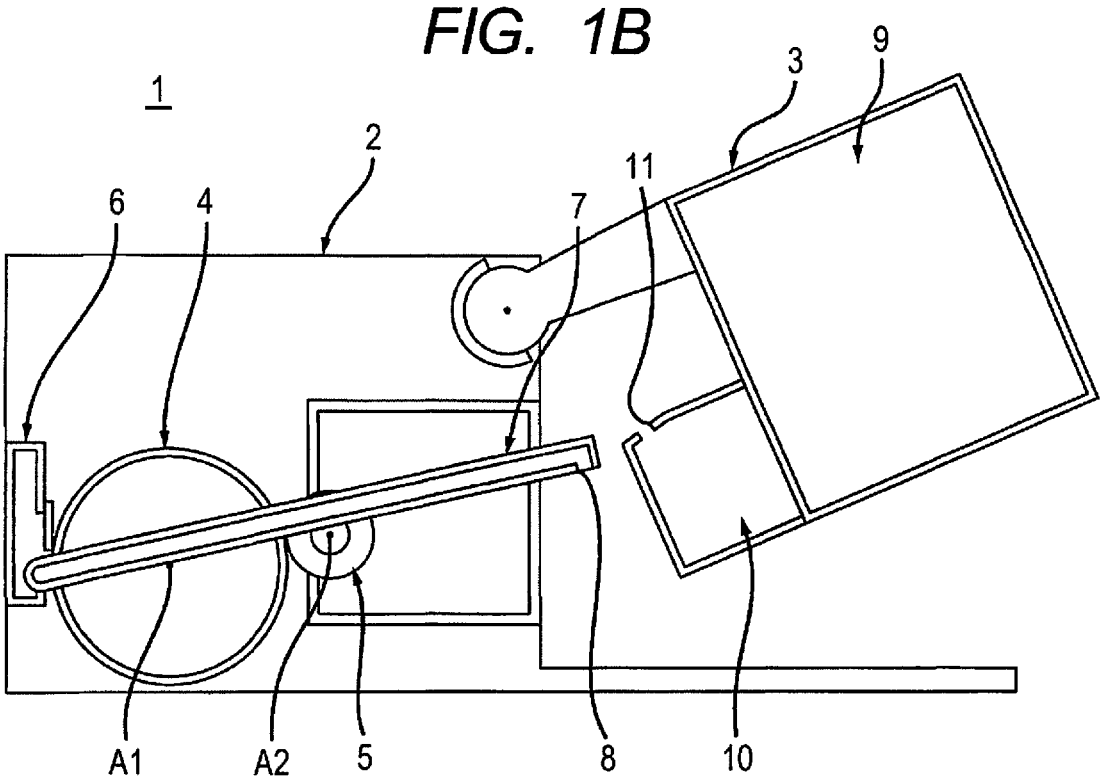
FIG. 1B is an explanatory diagram for schematically explaining the process cartridge of this disclosure, together with FIG. 1A, and shows a state where the toner cartridge is mounted on the drum unit and the toner cartridge is located at a first position.

The outline of a process cartridge 1 will be described with reference to FIG. 1A and FIG. 1B.

The process cartridge 1 includes a drum unit 2 and a toner cartridge 3.

1.1 Drum Unit 2

The drum unit 2 includes a photosensitive drum 4, a developing roller 5, a drum cleaner 6, and a waste-toner conveyance pipe 7.

1.1.1 Photosensitive Drum 4

The photosensitive drum 4 has a circumferential surface on which a toner image is formed. The photosensitive drum 4 is rotatable about a drum axis A1 extending in an axial direction. The drum axis A1 is a rotation axis of the photosensitive drum 4.

1.1.2 Developing Roller 5

The developing roller 5 is configured to supply a toner to the photosensitive drum 4. The developing roller 5 is in contact with the circumferential surface of the photosensitive drum 4. The developing roller 5 may be close to the circumferential surface of the photosensitive drum 4 with a space therebetween. The developing roller 5 is rotatable about a developing roller axis A2 extending in the axial direction.

1.1.3 Drum Cleaner 6

The drum cleaner 6 is configured to remove toner from the photosensitive drum 4. The toner removed from the photosensitive drum 4 is accumulated in the drum cleaner 6. The specific structure of the drum cleaner 6 will be described in detail later.

1.1.4 Waste-Toner Conveyance Pipe 7

The waste-toner conveyance pipe 7 is a pipe for conveying the toner removed from the photosensitive drum 4 by the drum cleaner 6. The waste-toner conveyance pipe 7 allows passing of the toner conveyed from the drum cleaner 6 to a waste-toner accommodation chamber 10 described later in a state (see FIG. 1A) where the toner cartridge 3 is mounted on the drum unit 2 and the toner cartridge 3 is located at a second position described later. The waste-toner conveyance pipe 7 has one end and the other end. The one end is connected to the drum cleaner 6. The other end is connected to the waste-toner accommodation chamber 10 in a state where the toner cartridge 3 is mounted on the drum unit 2 and the toner cartridge 3 is located at the second position. The specific structure of the waste-toner conveyance pipe 7 will be described in detail later. The waste-toner conveyance pipe 7 has a waste-toner discharge port 8.

The waste-toner discharge port 8 is configured to discharge the toner in the waste-toner conveyance pipe 7 in a state where the toner cartridge 3 is mounted on the drum unit 2 and the toner cartridge 3 is located at the second position. The waste-toner discharge port 8 is located at the other end of the waste-toner conveyance pipe 7. The waste-toner discharge port 8 has a rectangular shape.

1.2. Toner Cartridge 3

The toner cartridge 3 is mountable on the drum unit 2. The toner cartridge 3 is configured to rotatably move relative to the drum unit 2 between a first position (see FIG. 1B) in which a waste-toner receiving port 11 is separated from the waste-toner discharge port 8 in a state where the toner cartridge 3 is mounted on the drum unit 2, and a second position (see FIG. 1A) in which an internal space of the waste-toner accommodation chamber 10 and an internal space of the waste-toner conveyance pipe 7 communicate with each other through the waste-toner discharge port 8 and the waste-toner receiving port 11 in a state where the toner cartridge 3 is mounted on the drum unit 2. The toner cartridge 3 is detachable from the drum unit 2 in a state where the toner cartridge 3 is located at the first position. The toner cartridge 3 has a toner accommodation chamber 9, the waste-toner accommodation chamber 10, and the waste-toner receiving port 11. The internal space of the toner cartridge 3 is partitioned into the toner accommodation chamber 9 and the waste-toner accommodation chamber 10.

1.2.1 Toner Accommodation Chamber 9

The toner accommodation chamber 9 accommodates the toner to be supplied to the developing roller 5.

1.2.2 Waste-Toner Accommodation Chamber 10

The waste-toner accommodation chamber 10 accommodates the toner removed from the photosensitive drum 4 by the drum cleaner 6. The waste-toner accommodation chamber 10 is not in communication with the toner accommodation chamber 9.

1.2.3 Waste-Toner Receiving Port 11

The waste-toner receiving port 11 receives the toner discharged from the waste-toner discharge port 8 in a state where the toner cartridge 3 is mounted on the drum unit 2 and the toner cartridge 3 is located at the second position. The waste-toner receiving port 11 is in communication with the internal space of the waste-toner accommodation chamber 10. The waste-toner receiving port 11 is in communication with the waste-toner discharge port 8 in a state where the toner cartridge 3 is mounted on the drum unit 2 and the toner cartridge 3 is located at the second position. Thereby, in a state where the toner cartridge 3 is mounted on the drum unit 2 and the toner cartridge 3 is located at the second position, the internal space of the waste-toner accommodation chamber 10 and the internal space of the waste-toner conveyance pipe 7 communicate with each other through the waste-toner discharge port 8 and the waste-toner receiving port 11. In a state where the toner cartridge 3 is mounted on the drum unit 2 and the toner cartridge 3 is located at the second position, the toner removed from the photosensitive drum 4 by the drum cleaner 6 passes through the waste-toner conveyance pipe 7 and is accommodated in the waste-toner accommodation chamber 10 through the waste-toner receiving port 11 and the waste-toner discharge port 8.

2. Detail of Drum Unit 2

The detail of the drum unit 2 described above will be described with reference to FIG. 2 and FIG. 3.

Figure 2:
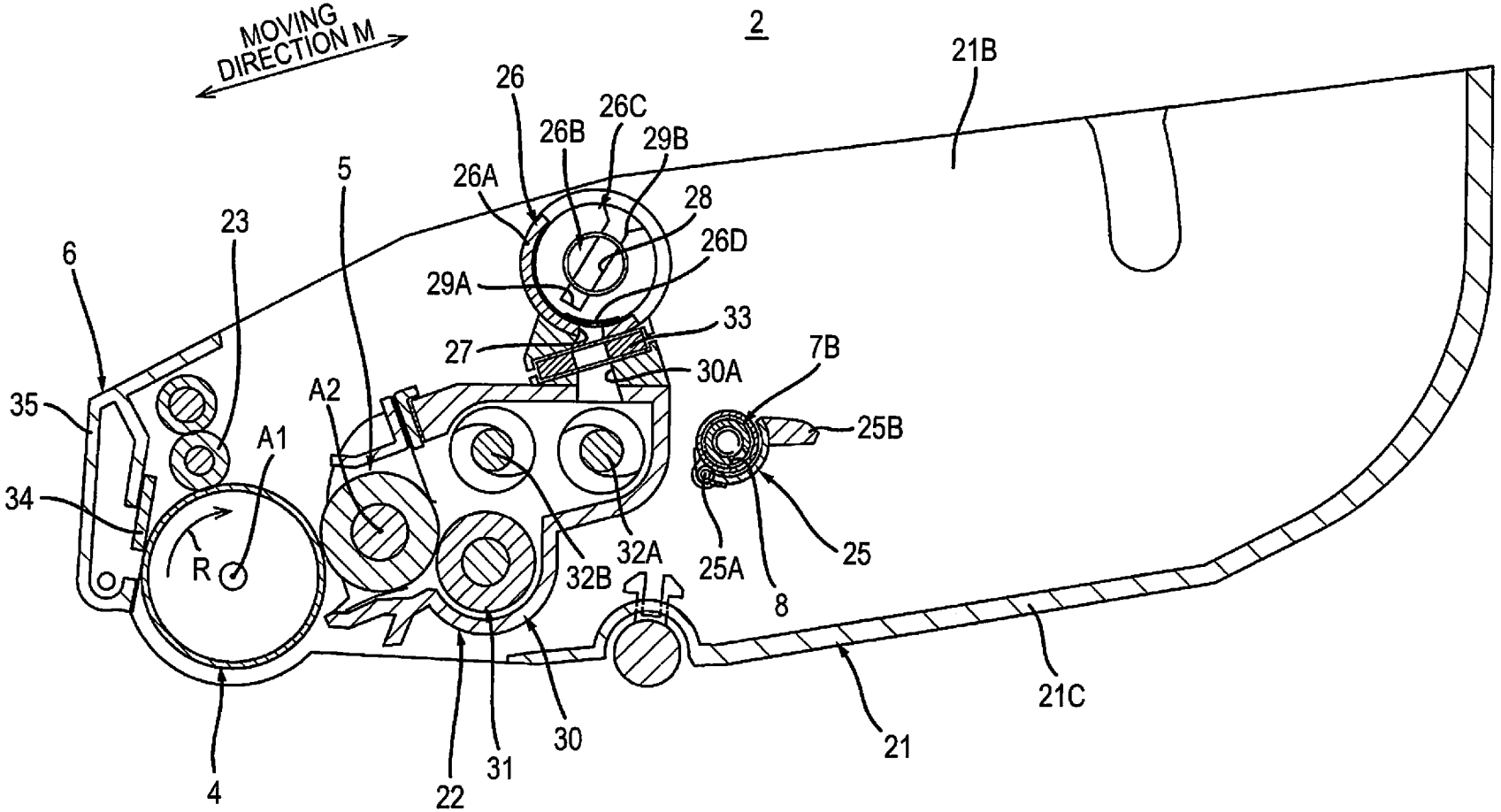
FIG. 2 shows the drum unit of a first embodiment and is a cross-sectional view along a line A-A in FIG. 3.

As shown in FIG. 2, the drum unit 2 includes the photosensitive drum 4 described above, a frame 21, a developing section 22 that accommodates the developing roller 5 described above, a charging roller 23, the drum cleaner 6 described above, the waste-toner conveyance pipe 7 (see FIG. 3) described above, a screw 24 (see FIG. 3), and a first shutter 25.

2.1. Frame 21

Figure 3:
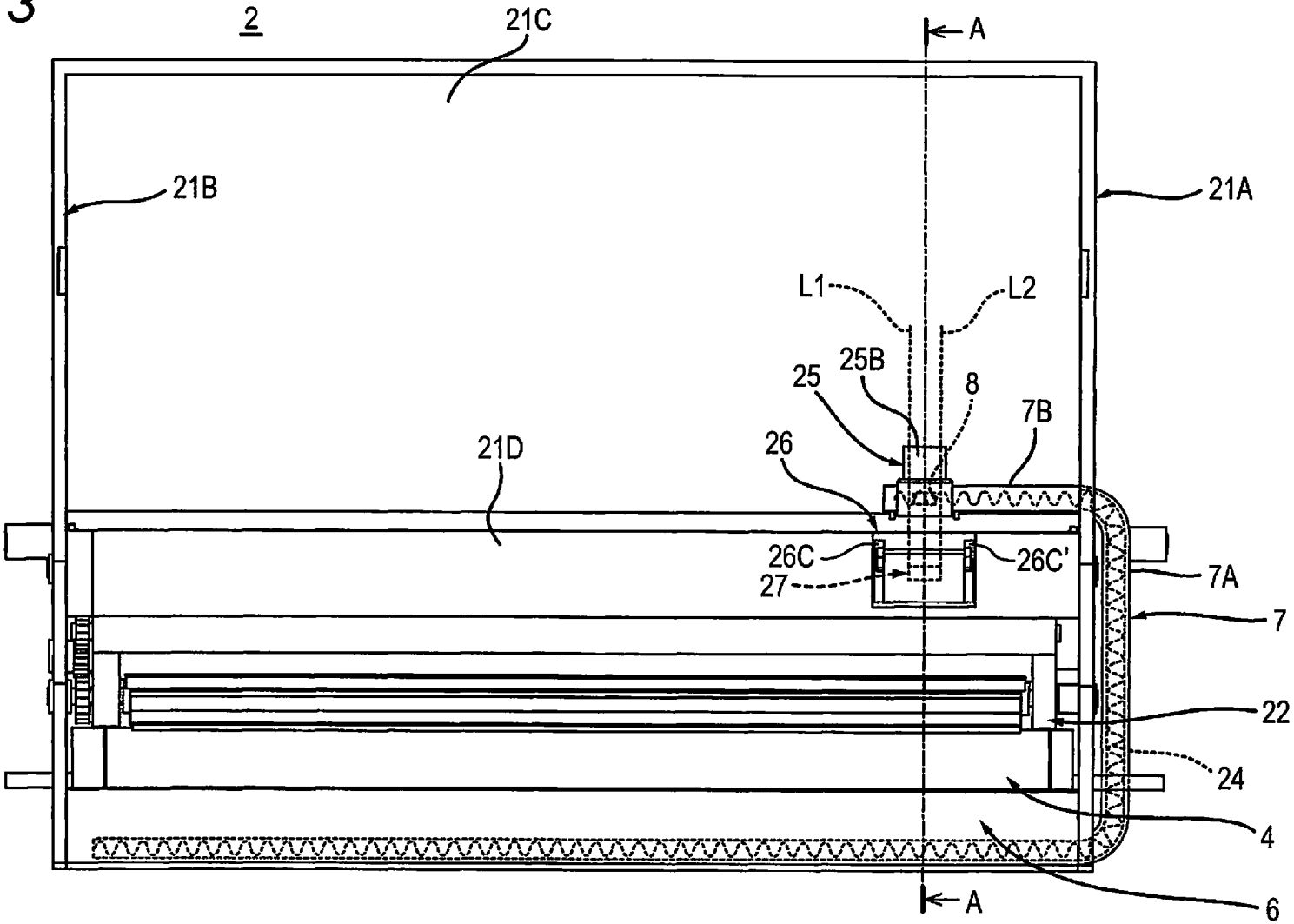
FIG. 3 is a plan view of the drum unit shown in FIG. 2.

The frame 21 supports the photosensitive drum 4, the developing section 22, the charging roller 23, the drum cleaner 6, and the waste-toner conveyance pipe 7. In a state where the toner cartridge 3 is mounted on the drum unit 2 and the toner cartridge 3 is located at the second position (see FIG. 7), the frame 21 supports the toner cartridge 3. As shown in FIG. 3, the frame 21 has a first side plate 21A, a second side plate 21B, a connection plate 21C, a connecting cylinder 21D, and a connection portion 26.

2.1.1 First Side Plate 21A, Second Side Plate 21B, and Connection Plate 21C The first side plate 21A supports the waste-toner conveyance pipe 7.

The second side plate 21B is located with an interval with respect to the first side plate 21A in an axial direction. The photosensitive drum 4 and the developing section 22 are located between the first side plate 21A and the second side plate 21B in the axial direction.

The connection plate 21C is located between the first side plate 21A and the second side plate 21B in the axial direction. The connection plate 21C extends in the axial direction. The connection plate 21C has one end and an other end in the axial direction. The one end of the connection plate 21C is connected to the first side plate 21A. The other end of the connection plate 21C is connected to the second side plate 21B.

The connecting cylinder 21D is located between the first side plate 21A and the second side plate 21B in the axial direction. The connecting cylinder 21D extends in the axial direction. The connecting cylinder 21D has one end and an other end in the axial direction. The one end of the connecting cylinder 21D is connected to the first side plate 21A. The other end of the connecting cylinder 21D is connected to the second side plate 21B. The connecting cylinder 21D is provided with the connection portion 26.

2.1.2 Connection Portion 26

In a state where the toner cartridge 3 is mounted on the drum unit 2 and the toner cartridge 3 is located at the second position, the connection portion 26 is connected to a connection portion 41 (see FIG. 7) of the toner cartridge 3 described later. The connection portion 26 is located between the first side plate 21A and the second side plate 21B in the axial direction. The connection portion 26 is located closer to the first side plate 21A than to the second side plate 21B in the axial direction. As shown in FIG. 2, the connection portion 26 includes an arc wall 26A, a first fixation portion 26B, a second fixation portion (not shown), a first rotation portion 26C, a second rotation portion 26C' (FIG. 3), and a shutter 26D.

2.1.2.1 Arc Wall 26A

The arc wall 26A receives a cylindrical portion 43 (see FIG. 4) of the toner cartridge 3 described later in a state where the connection portion 26 is connected to the connection portion 41. The arc wall 26A extends along the circumferential surface of the cylindrical portion 43 in a state where the connection portion 26 is connected to the connection portion 41. The arc wall 26A has a toner receiving port 27. That is, the toner receiving port 27 is provided at the frame 21, and the drum unit 2 has the toner receiving port 27. Thereby, the toner receiving port 27 does not move relative to the mounted toner cartridge 3, and leaking of the toner from between the connection portion 41 and the connection portion 26 can be prevented.

The toner receiving port 27 receives the toner discharged from a toner discharge port 43A (see FIG. 4) in a state where the connection portion 26 is connected to the connection portion 41. As shown in FIG. 3, the toner receiving port 27 is located closer to the first side plate 21A than to the second side plate 21B in the axial direction. The toner receiving port 27 extends in the axial direction. The toner receiving port 27 has a rectangular shape. The toner receiving port 27 has one end and an other end in the axial direction. The waste-toner discharge port 8 is located between a virtual line L1 extending in a direction perpendicular to the axial direction along the one end of the toner receiving port 27 and a virtual line L2 extending in parallel with the virtual line L1 along the other end of the toner receiving port 27. That is, at least part of the toner receiving port 27 overlaps the waste-toner discharge port 8 when viewed from a direction perpendicular to the axial direction. Thereby, the user can connect the waste-toner conveyance pipe 7 and the waste-toner accommodation chamber 10 near the connection portion 26 and the connection portion 41, when the toner cartridge 3 is mounted onto the drum unit 2. Mounting of the toner cartridge 3 onto the drum unit 2 can be stably performed.

2.1.2.2 First Fixation Portion 26B and Second Fixation Portion

The first fixation portion 26B shown in FIG. 2 fixes a shutter 45 (see FIG. 6) of the toner cartridge 3 described later to the drum unit 2 in a state where the toner cartridge 3 is mounted on the drum unit 2 and the toner cartridge 3 is located at the first position. The first fixation portion 26B has a circular plate shape. The first fixation portion 26B has a groove 28. The groove 28 extends in a radial direction of the first fixation portion 26B. A first rib 48A (see FIG. 5) of the toner cartridge 3 described later fits in the groove 28 in a state where the toner cartridge 3 is mounted on the drum unit 2. Thereby, the shutter 45 of the toner cartridge 3 is not rotatable relative to the drum unit 2 in a state where the toner cartridge 3 is mounted on the drum unit 2.

The second fixation portion (not shown) fixes the shutter 45 (see FIG. 6) to the drum unit 2 together with the first fixation portion 26B in a state where the toner cartridge 3 is mounted on the drum unit 2 and the toner cartridge 3 is located at the first position. The second fixation portion is located at the opposite side of the first fixation portion 26B with respect to the shutter 45 in the axial direction in a state where the toner cartridge 3 is mounted on the drum unit 2 and the toner cartridge 3 is located at the first position. The second fixation portion has the same shape as the first fixation portion. A second rib 48B (see FIG. 5) of the toner cartridge 3 described later fits in a groove of the second fixation portion.

2.1.2.3 First Rotation Portion 26C and Second Rotation Portion 26C'

The first rotation portion 26C is fixed to the cylindrical portion 43 (see FIG. 6) of the toner cartridge 3 described later in a state where the toner cartridge 3 is mounted on the drum unit 2 and the toner cartridge 3 is located at the first position. The first rotation portion 26C is rotatable about the first fixation portion 26B. The first rotation portion 26C is located at the periphery of the first fixation portion 26B. The first rotation portion 26C has a ring shape. The first rotation portion 26C has a first groove 29A and a second groove 29B.

The first groove 29A is located between the groove 28 of the first fixation portion 26B and the arc wall 26A in a state where the toner cartridge 3 is dismounted from the drum unit 2. The first groove 29A continues to the groove 28 of the first fixation portion 26B in a state where the toner cartridge 3 is dismounted from the drum unit 2. A first boss 47A (see FIG. 5) of the toner cartridge 3 fits in the first groove 29A in a state where the toner cartridge 3 is mounted on the drum unit 2 and the toner cartridge 3 is located at the first position.

The second groove 29B is located at the opposite side of the first groove 29A with respect to the groove 28 of the first fixation portion 26B in a state where the toner cartridge 3 is dismounted from the drum unit 2. The second groove 29B continues to the groove 28 of the first fixation portion 26B in a state where the toner cartridge 3 is dismounted from the drum unit 2. A second boss 47B (see FIG. 5) of the toner cartridge 3 fits in the second groove 29B in a state where the toner cartridge 3 is mounted on the drum unit 2 and the toner cartridge 3 is located at the first position. By fitting the first boss 47A of the toner cartridge 3 in the first groove 29A and fitting the second boss 47B of the toner cartridge 3 in the second groove 29B, the first rotation portion 26C is fixed to the cylindrical portion 43. Thereby, the first rotation portion 26C rotates with the toner cartridge 3 when the toner cartridge 3 rotatably moves between the first position and the second position.

The second rotation portion 26C' is fixed to the cylindrical portion 43 (see FIG. 6) in a state where the toner cartridge 3 is mounted on the drum unit 2 and the toner cartridge 3 is located at the first position. The second rotation portion 26C' is located at the opposite side of the first rotation portion 26C with respect to the cylindrical portion 43 in the axial direction in a state where the toner cartridge 3 is mounted on the drum unit 2 and the toner cartridge 3 is located at the first position. The second rotation portion 26C' is located at the periphery of the second fixation portion. The second rotation portion 26C' is rotatable about the second fixation portion. The second rotation portion 26C' has the same shape as the first rotation portion 26C. The second rotation portion 26C' has a third groove having the same shape as the first groove 29A, and a fourth groove (not shown) having the same shape as the second groove 29B. In a state where the toner cartridge 3 is mounted on the drum unit 2 and the toner cartridge 3 is located at the first position, a third boss 47C (see FIG. 5) of the toner cartridge 3 fits in the third groove, and a fourth boss 47D (see FIG. 5) of the toner cartridge 3 fits in the fourth groove. Thereby, the second rotation portion 26C' rotates together with the toner cartridge 3 when the toner cartridge 3 rotatably moves between the first position and the second position as similar to the first rotation portion 26C.

2.1.2.4 Shutter 26D

The shutter 26D shown in FIG. 2 is movable between an open position (see FIG. 7) in which the toner receiving port 27 is opened and a closed position (see FIG. 2) in which the toner receiving port 27 is closed. The shutter 26D extends along the arc wall 26A. The shutter 26D extends in the axial direction. The shutter 26D has a plate shape. The shutter 26D has one end and an other end in the axial direction. The one end of the shutter 26D is connected to the first rotation portion 26C. The other end of the shutter 26D is connected to the second rotation portion 26C'. Thereby, the shutter 26D moves between the open position and the closed position together with the first rotation portion 26C and the second rotation portion 26C' when the toner cartridge 3 rotatably moves between the first position and the second position. The shutter 26D is located at the closed position when the toner cartridge 3 is located at the first position and is located at the open position when the toner cartridge 3 is located at the second position.

2.2 Developing Section 22

Figure 7:
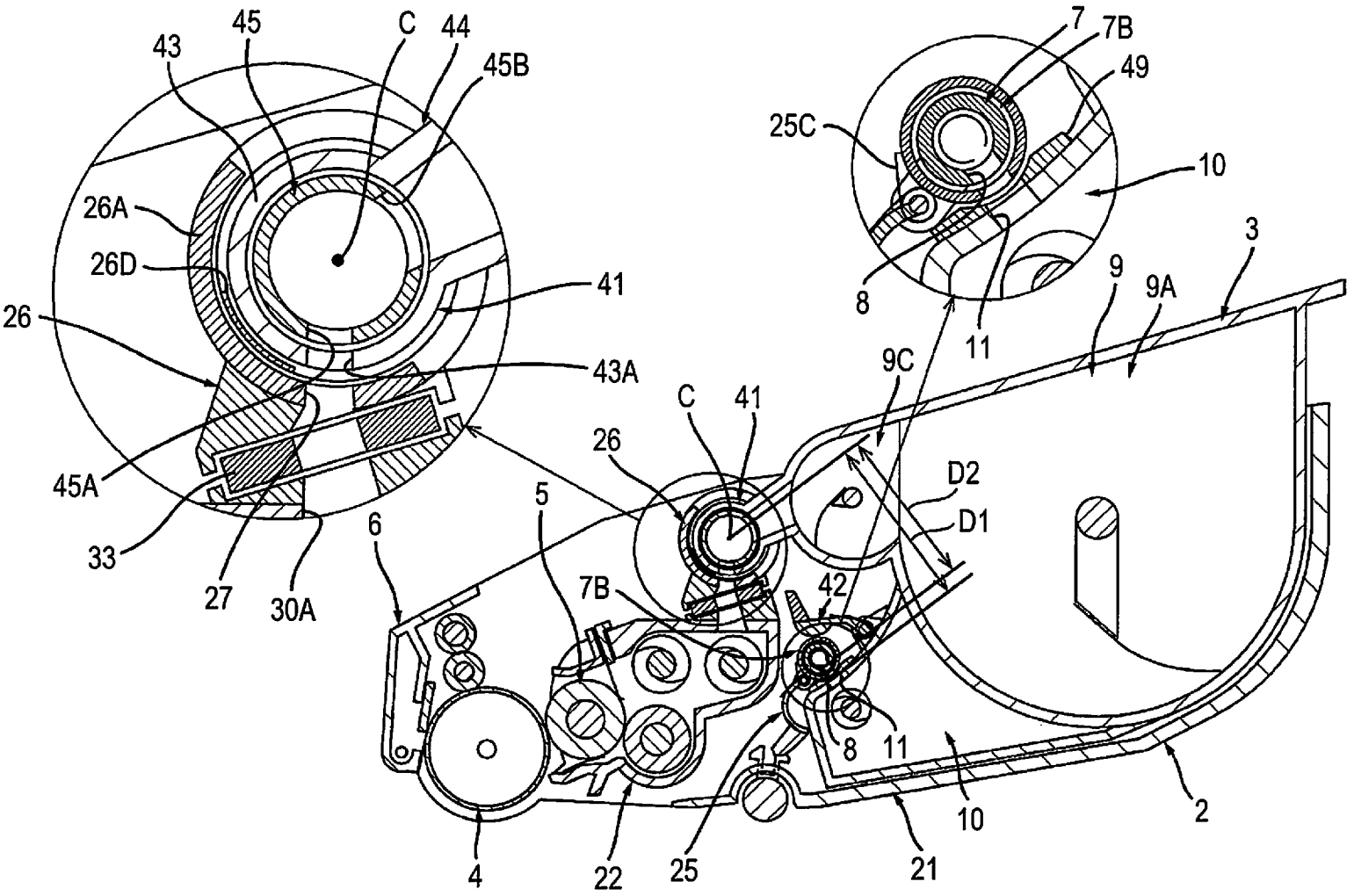
FIG. 7 is an explanatory diagram for explaining mounting of the toner cartridge on the drum unit in the first embodiment, together with FIG. 6, and shows a state where the toner cartridge is mounted on the drum unit and the toner cartridge is located at the second position.

The developing section 22 shown in FIG. 2 is connected to the toner cartridge 3 through the connection portion 26 when the toner cartridge 3 is mounted on the drum unit 2 and the toner cartridge 3 is located at the second position (see FIG. 7). The developing section 22 is supplied with the toner from the toner accommodation chamber 9 in a state where the toner cartridge 3 is mounted on the drum unit 2 and the toner cartridge 3 is located at the second position. The developing section 22 is configured to supply the toner supplied from the toner cartridge 3 to the photosensitive drum 4. The developing section 22 is movable relative to the photosensitive drum 4 and the frame 21. Specifically, the developing section 22 is movable relative to the photosensitive drum 4 and the frame 21 in a moving direction M intersecting the axial direction. Preferably, the moving direction M is perpendicular to the axial direction. Specifically, the moving direction M is a direction in which the drum axis A1 and the developing roller axis A2 are arranged. The developing section 22 includes a developing frame 30, the developing roller 5, a supplying roller 31, an auger screw 32A, and an auger screw 32B.

2.2.1 Developing Frame 30

The developing frame 30 accommodates the toner supplied from the toner cartridge 3. The developing frame 30 extends in the axial direction. The developing frame 30 has a box shape. The developing frame 30 has an opening 30A.

The opening 30A receives the toner that has passed the toner receiving port 27. The opening 30A is in communication with the toner receiving port 27. The opening 30A is in communication with an internal space of the developing frame 30. A seal member 33 is interposed between the connection portion 26 and the developing frame 30. The seal member 33 seals between the connection portion 26 and the developing frame 30 while allowing passage of the toner from the toner receiving port 27 to the opening 30A. The seal member 33 is located at the periphery of the toner receiving port 27 and is located at the periphery of the opening 30A.

2.2.2 Developing Roller 5

The developing roller 5 is exposed from the developing frame 30. Specifically, a part of the developing roller 5 is exposed from the developing frame 30. An other part of the developing roller 5, that is, a part other than the part exposed from the developing section 22 is accommodated in the developing frame 30.

2.2.3 Supplying Roller 31

The supplying roller 31 is configured to supply the toner in the developing frame 30 to the developing roller 5. The supplying roller 31 is located in the developing frame 30. The supplying roller 31 is in contact with a circumferential surface of the developing roller 5.

2.2.4 Auger Screw 32A and Auger Screw 32B

The auger screw 32A is configured to convey the toner in the developing frame 30 in the axial direction. Specifically, the auger screw 32A is configured to convey the toner in the developing frame 30 in a direction separating from the toner receiving port 27 described later in the axial direction. The auger screw 32A is located in the developing frame 30. The auger screw 32A extends in the axial direction. The auger screw 32A is located below the opening 30A in a state where the process cartridge 1 is mounted on an image forming apparatus 100 (see FIG. 8) described later.

The auger screw 32B is configured to convey the toner in the developing frame 30 in an opposite direction from the direction in which the auger screw 32A conveys the toner in the developing frame 30 in the axial direction. Specifically, the auger screw 32B is configured to convey the toner in the developing frame 30 in a direction approaching the toner receiving port 27 in the axial direction. The auger screw 32B is located in the developing frame 30. The auger screw 32B extends in the axial direction. The auger screw 32B is located between the developing roller 5 and the auger screw 32A in the moving direction M. The auger screw 32B is located above the supplying roller 31 in a state where the process cartridge 1 is mounted on the image forming apparatus 100 (see FIG. 8) described later. The auger screw 32B is aligned with the auger screw 32A in a horizontal direction in a state where the process cartridge 1 is mounted on the image forming apparatus 100 (see FIG. 8) described later.

2.3 Charging Roller 23

The charging roller 23 is configured to charge the surface of the photosensitive drum 4. The charging roller 23 is located at an upstream side of the developing roller 5 and at a downstream side of the drum cleaner 6 in a direction R in which the photosensitive drum 4 rotates. The charging roller 23 is in contact with the surface of the photosensitive drum 4.

2.4 Detail of Drum Cleaner 6

The drum cleaner 6 described above is located at the opposite side of the developing section 22 with respect to the photosensitive drum 4 in the moving direction M of the developing section 22. The drum cleaner 6 includes a cleaning blade 34 and a cleaning frame 35.

The cleaning blade 34 is in contact with the surface of the photosensitive drum 4. The cleaning blade 34 extends in the axial direction. The cleaning blade 34 has a plate shape. When the photosensitive drum 4 rotates, the toner adhered to the surface of the photosensitive drum 4 is removed from the surface of the photosensitive drum 4 by the cleaning blade 34.

The cleaning frame 35 accommodates the toner removed from the photosensitive drum 4 by the cleaning blade 34.

2.5 Detail of Waste-Toner Conveyance Pipe 7

As shown in FIG. 3, the waste-toner conveyance pipe 7 has a first portion 7A and a second portion 7B.

The first portion 7A is located at the opposite side of the photosensitive drum 4 and the developing section 22 with respect to the first side plate 21A in the axial direction. The first portion 7A extends along the first side plate 21A. The first portion 7A is connected to the drum cleaner 6. An internal space of the first portion 7A is in communication with the internal space of the drum cleaner 6.

The second portion 7B is located at the opposite side of the photosensitive drum 4 with respect to the developing section 22 in the moving direction M (see FIG. 2) of the developing section 22. The second portion 7B extends in the axial direction from the first portion 7A. The second portion 7B has the waste-toner discharge port 8 described above.

The waste-toner discharge port 8 is located between the first side plate 21A and the second side plate 21B in the axial direction. Thereby, even if the toner leaks from the waste-toner discharge port 8, the leaked toner falls on the connection plate 21C between the first side plate 21A and the second side plate 21B, and contamination of the periphery of the process cartridge 1 by the leaked toner can be prevented. Specifically, the waste-toner discharge port 8 is located closer to the first side plate 21A than to the second side plate 21B in the axial direction. The waste-toner discharge port 8 is located at a position lower than the toner receiving port 27 and between the developing section 22 and the toner accommodation chamber 9 in a state where the toner cartridge 3 is mounted on the drum unit 2 and the toner cartridge 3 is located at the second position (see FIG. 7).

2.6 Screw 24

The screw 24 is configured to convey the toner from the drum cleaner 6 toward the waste-toner discharge port 8. The screw 24 is located inside the drum cleaner 6 and the waste-toner conveyance pipe 7.

2.7 First Shutter 25

The first shutter 25 shown in FIG. 2 is movable between the open position (see FIG. 7) for opening the waste-toner discharge port 8 and the closed position (see FIG. 2) for closing the waste-toner discharge port 8. Specifically, the first shutter 25 is movable rotatably between the open position and the closed position. The first shutter 25 is located at the closed position when the toner cartridge 3 is located at the first position (see FIG. 6). Thereby, when the waste-toner conveyance pipe 7 is not connected to the waste-toner accommodation chamber 10, the first shutter 25 closes the waste-toner discharge port 8 and the toner is prevented from leaking from the waste-toner discharge port 8. The first shutter 25 is located at the open position when the toner cartridge 3 is located at the second position (see FIG. 7). The first shutter 25 moves from the closed position to the open position by making contact with the toner cartridge 3 when the toner cartridge 3 rotatably moves from the first position to the second position. Thereby, by utilizing the rotation movement from the first position to the second position of the toner cartridge 3, the first shutter 25 is moved from the closed position to the open position to connect the waste-toner conveyance pipe 7 and the waste-toner accommodation chamber 10. The first shutter 25 extends along an outer circumferential surface of the second portion 7B of the waste-toner conveyance pipe 7 in a state where the first shutter 25 is located at the closed position. The first shutter 25 has one end and an other end in the circumferential direction of the second portion 7B. In a state where the first shutter 25 is located at the closed position, the one end is located between the other end and the developing section 22 in the moving direction M of the developing section 22. The first shutter 25 has a pivotal axis 25A, a first protrusion 25B, and a spring 25C (see FIG. 7).

The pivotal axis 25A is located at the one end of the first shutter 25. The pivotal axis 25A extends in the axial direction. The first shutter 25 is movable rotatably between the open position and the closed position about the pivotal axis 25A.

The first protrusion 25B protrudes from the other end of the first shutter 25. The first protrusion 25B is located at the opposite side of the developing section 22 with respect to the second portion 7B in a state where the first shutter 25 is located at the closed position. The first protrusion 25B makes contact with the toner cartridge 3 when the toner cartridge 3 rotatably moves from the first position to the second position. By providing the first protrusion 25B, the toner cartridge 3 reliably makes contact with the first shutter 25. The first shutter 25 moves from the closed position to the open position against an urging force of the spring 25C by contact of the first protrusion 25B with the toner cartridge 3 when the toner cartridge 3 rotatably moves from the first position to the second position. The shape of the first protrusion 25B is not particularly limited. The shape of the first protrusion 25B may be, for example, a column, a cone, a prism, or a pyramid.

As shown in FIG. 7, the spring 25C urges the first shutter 25 located at the open position to the closed position. Thereby, the first shutter 25 moves from the open position to the closed position by the urging force of the spring 25C when the toner cartridge 3 rotatably moves from the second position to the first position and the toner cartridge 3 separates from the first shutter 25. The spring 25C urges the first shutter 25 located at the closed position so as to maintain the first shutter 25 to be in the closed position in a state where the toner cartridge 3 is not in contact with the first shutter 25. Specifically, the spring 25C is a torsion spring.

3. Detail of Toner Cartridge 3

The detail of the toner cartridge 3 described above will be described with reference to FIG. 4 and FIG. 5.

Figure 4:
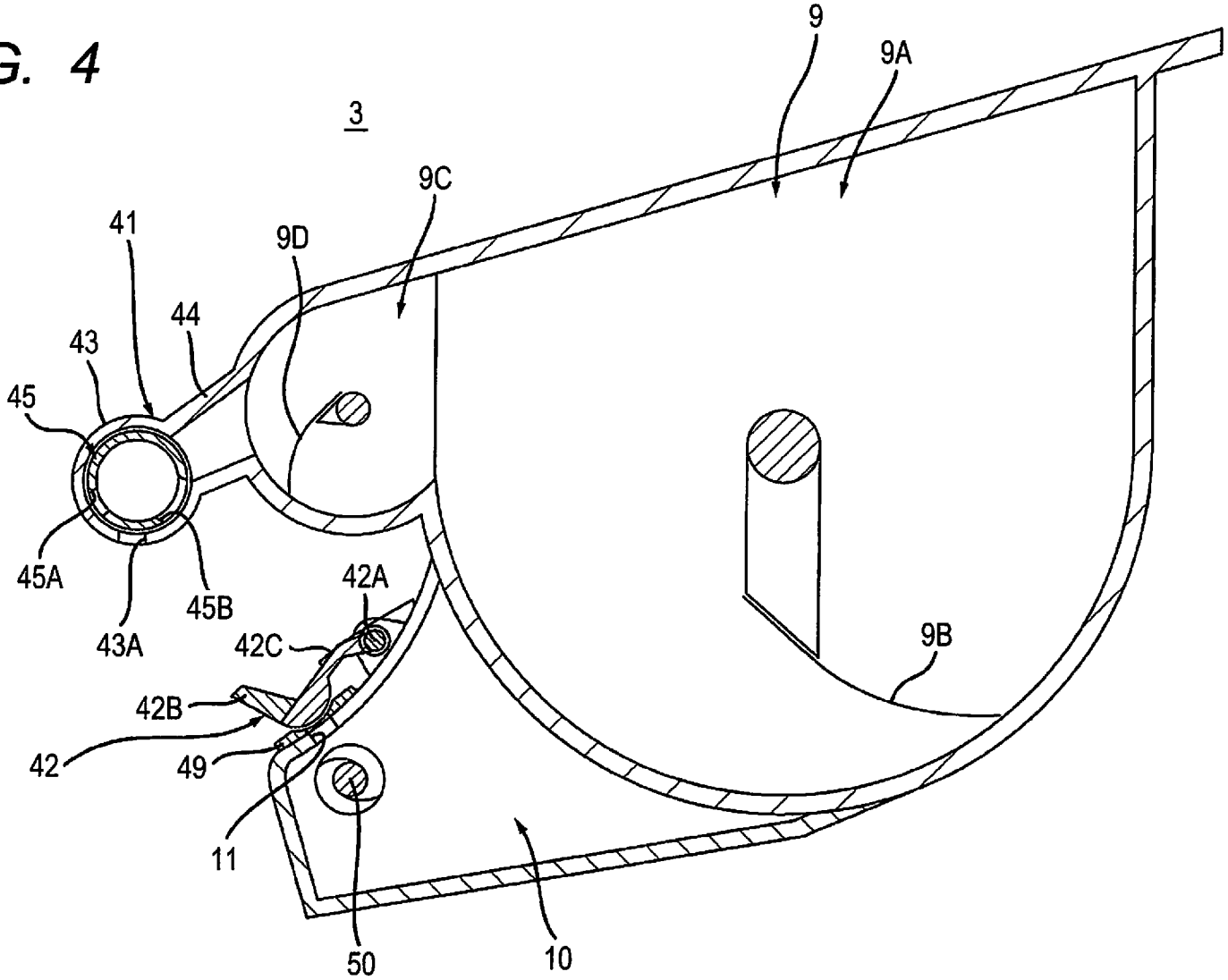
FIG. 4 shows the toner cartridge of the first embodiment and is a cross-sectional view along a line B-B in FIG. 5.

As shown in FIG. 4, the toner cartridge 3 includes the toner accommodation chamber 9 described above, the connection portion 41, the waste-toner accommodation chamber 10 described above, and a second shutter 42.

3.1 Detail of Toner Accommodation Chamber 9

The toner accommodation chamber 9 includes a first accommodation chamber 9A, a first agitator 9B, a second accommodation chamber 9C, and a second agitator 9D.

The first accommodation chamber 9A extends in the axial direction. The first accommodation chamber 9A accommodates the toner to be supplied to the developing roller 5.

The first agitator 9B is configured to agitate the toner in the first accommodation chamber 9A and convey the toner in the first accommodation chamber 9A to the second accommodation chamber 9C. The first agitator 9B is located in the first accommodation chamber 9A. The first agitator 9B is rotatable about the rotation axis extending in the axial direction.

The second accommodation chamber 9C accommodates the toner conveyed from the first accommodation chamber 9A by the first agitator 9B. The second accommodation chamber 9C is located between the first accommodation chamber 9A and the connection portion 41. The second accommodation chamber 9C is located above the waste-toner accommodation chamber 10 in a state where the process cartridge 1 is mounted on the image forming apparatus 100 (see FIG. 8) described later. The second accommodation chamber 9C extends in the axial direction. An internal space of the second accommodation chamber 9C is in communication with an internal space of the first accommodation chamber 9A. The volume of the second accommodation chamber 9C is smaller than the volume of the first accommodation chamber 9A.

The second agitator 9D is configured to convey the toner in the second accommodation chamber 9C to the connection portion 41. The second agitator 9D is located in the second accommodation chamber 9C. The second agitator 9D is rotatable about a rotation axis extending in the axial direction.

3.2 Connection Portion 41

The connection portion 41 connects to the connection portion 26 (see FIG. 7) of the drum unit 2 when the toner cartridge 3 is mounted on the drum unit 2. Thereby, the connection portion 41 connects to the developing section 22 through the connection portion 26 when the toner cartridge 3 is mounted on the drum unit 2. The connection portion 41 protrudes from the toner accommodation chamber 9. The connection portion 41 includes the cylindrical portion 43, a connection pipe 44, a shutter 45, the first boss 47A (see FIG. 5), the second boss 47B (see FIG. 5), the third boss 47C (see FIG. 5), the fourth boss 47D (see FIG. 5), the first rib 48A (see FIG. 5), and the second rib 48B (see FIG. 5).

3.2.1 Cylindrical Portion 43

The cylindrical portion 43 makes contact with the arc wall 26A (see FIG. 7) of the drum unit 2 in a state where the connection portion 41 is connected to the connection portion 26. The cylindrical portion 43 extends in the axial direction. The cylindrical portion 43 has the toner discharge port 43A. That is, the toner cartridge 3 has the toner discharge port 43A.

The toner discharge port 43A is configured to discharge the toner in the connection portion 41. The toner discharge port 43A is in communication with the internal space of the connection portion 41. The toner discharge port 43A is in communication with the toner receiving port 27 (see FIG. 7) of the drum unit 2 in a state where the toner cartridge 3 is mounted on the drum unit 2 and the toner cartridge 3 is located at the second position. Thereby, the internal space of the developing section 22 and the internal space of the toner accommodation chamber 9 communicate with each other through the toner receiving port 27 and the toner discharge port 43A when the toner cartridge 3 is mounted on the drum unit 2 and the toner cartridge 3 is located at the second position. Thereby, by utilizing the connection portion 41, the toner is supplied from the toner cartridge 3 to the developing section 22.

3.2.2 Connection Pipe 44

The connection pipe 44 connects the cylindrical portion 43 with the toner accommodation chamber 9. Specifically, the connection pipe 44 connects the cylindrical portion 43 with the second accommodation chamber 9C. The connection pipe 44 is located between the cylindrical portion 43 and the second accommodation chamber 9C. An internal space of the connection pipe 44 is in communication with the internal space of the cylindrical portion 43. The internal space of the connection pipe 44 is in communication with the internal space of the second accommodation chamber 9C. The toner conveyed by the second agitator 9D passes through the internal space of the connection pipe 44 toward the cylindrical portion 43.

3.2.3 Shutter 45

The shutter 45 is movable relative to the cylindrical portion 43, between the open position (see FIG. 7) for opening the toner discharge port 43A and the closed position (see FIG. 4) for closing the toner discharge port 43A. The shutter 45 is located inside the cylindrical portion 43. The shutter 45 has a cylindrical shape. The shutter 45 extends in the axial direction. The shutter 45 is rotatable relative to the cylindrical portion 43. The shutter 45 has a first opening 45A and a second opening 45B.

The first opening 45A overlaps the toner discharge port 43A in a radial direction of the cylindrical portion 43 when the shutter 45 is located at the open position. Thereby, the first opening 45A is in communication with the toner discharge port 43A when the shutter 45 is located at the open position. When the shutter 45 is located at the closed position, the first opening 45A is located at a different position from the toner discharge port 43A in the rotation direction of the shutter 45. Thereby, the first opening 45A does not communicate with the toner discharge port 43A when the shutter 45 is located at the closed position. When the shutter 45 is located at the closed position, the outer circumferential surface of the shutter 45 closes the toner discharge port 43A.

The second opening 45B overlaps the internal space of the connection pipe 44 in the radial direction of the cylindrical portion 43 when the shutter 45 is located at the open position. Thereby, the second opening 45B is in communication with the internal space of the connection pipe 44 when the shutter 45 is located at the open position.

Figure 5:
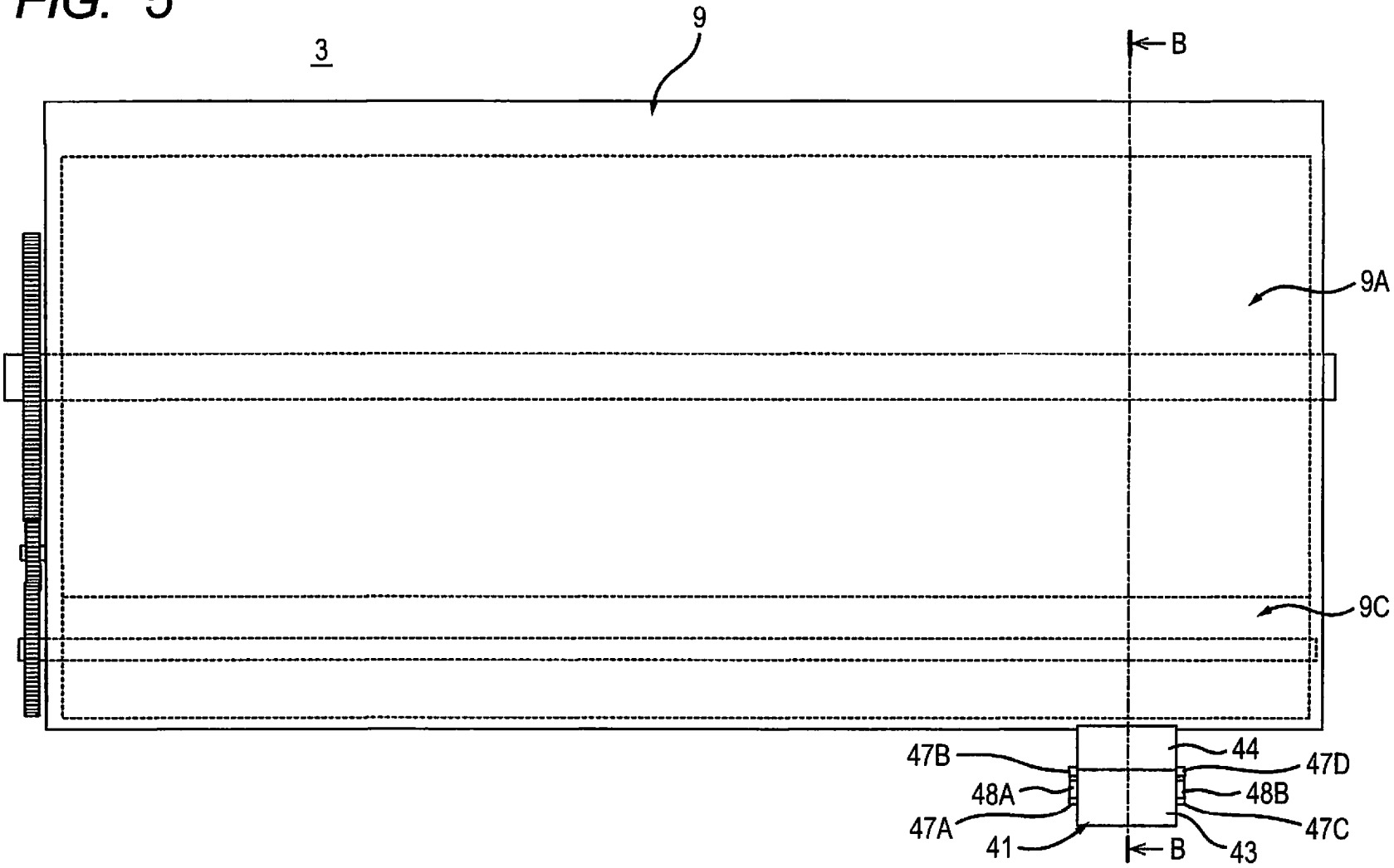
FIG. 5 is a plan view of the toner cartridge shown in FIG. 4.

3.2.4 First Boss 47A, Second Boss 47B, Third Boss 47C, and Fourth Boss 47D As shown in FIG. 5, the first boss 47A protrudes from the cylindrical portion 43 in the axial direction. The first boss 47A fits in the first groove 29A (see FIG. 2) when the toner cartridge 3 is mounted on the drum unit 2.

The second boss 47B protrudes from the cylindrical portion 43 in the axial direction. The second boss 47B fits in the second groove 29B (see FIG. 2) when the toner cartridge 3 is mounted on the drum unit 2. The second boss 47B is located between the first boss 47A and the toner accommodation chamber 9. The second boss 47B is spaced away from the first boss 47A with an interval therebetween.

The third boss 47C is located at the opposite side from the first boss 47A with respect to the cylindrical portion 43 in the axial direction. The third boss 47C protrudes from the cylindrical portion 43 in the axial direction. The third boss 47C fits in the third groove (not shown) of the second rotation portion 26C' of the drum unit 2 when the toner cartridge 3 is mounted on the drum unit 2.

The fourth boss 47D is located at the opposite side from the second boss 47B with respect to the cylindrical portion 43 in the axial direction. The fourth boss 47D protrudes from the cylindrical portion 43 in the axial direction. The fourth boss 47D fits in the fourth groove (not shown) of the second rotation portion 26C' of the drum unit 2 when the toner cartridge 3 is mounted on the drum unit 2. The fourth boss 47D is located between the third boss 47C and the toner accommodation chamber 9. The fourth boss 47D is spaced away from the third boss 47C with an interval therebetween.

3.2.5 First Rib 48A and Second Rib 48B

The first rib 48A fits in the groove 28 (see FIG. 2) of the first fixation portion 26B in a state where the toner cartridge 3 is mounted on the drum unit 2 and the toner cartridge 3 is located at the first position. The first rib 48A is located between the first boss 47A and the second boss 47B. The first rib 48A protrudes from the shutter 45 (see FIG. 4) in the axial direction. The first rib 48A extends in a radial direction of the shutter 45.

The second rib 48B fits in the groove of the second fixation portion (not shown) in a state where the toner cartridge 3 is mounted on the drum unit 2 and the toner cartridge 3 is located at the first position. The second rib 48B is located at the opposite side of the first rib 48A with respect to the shutter 45 in the axial direction. The second rib 48B is located between the third boss 47C and the fourth boss 47D. The second rib 48B protrudes from the shutter 45 in the axial direction. The second rib 48B extends in the radial direction of the shutter 45.

3.3 Detail of Waste-Toner Accommodation Chamber 10

The waste-toner accommodation chamber 10 shown in FIG. 4 is located below the second accommodation chamber 9C and between the developing section 22 (see FIG. 7) and the first accommodation chamber 9A when the toner cartridge 3 is mounted on the drum unit 2 and the toner cartridge 3 is located at the second position. The waste-toner accommodation chamber 10 has the waste-toner receiving port 11 described above. The waste-toner accommodation chamber 10 includes a seal member 49 and a screw 50.

The waste-toner receiving port 11 is provided in a peripheral wall of the waste-toner accommodation chamber 10. In a state where the toner cartridge 3 is mounted on the drum unit 2, a distance D1 (see FIG. 7) from a rotation center C of the toner cartridge 3 to the waste-toner receiving port 11 is longer than a distance D2 (see FIG. 7) from the rotation center C to the waste-toner discharge port 8. Thereby, when the toner cartridge 3 is mounted on the drum unit 2, the waste-toner receiving port 11 is smoothly located below the waste-toner discharge port 8, and the waste-toner receiving port 11 and the waste-toner discharge port 8 are made to face each other.

The seal member 49 is located at the periphery of the waste-toner receiving port 11. The seal member 49 is interposed between the second shutter 42 and the waste-toner accommodation chamber 10 when the second shutter 42 is located at the closed position. Thereby, the seal member 49 seals between the second shutter 42 and the waste-toner accommodation chamber 10 when the second shutter 42 is located at the closed position. The seal member 49 is interposed between the waste-toner conveyance pipe 7 (see FIG. 7) and the waste-toner accommodation chamber 10 when the toner cartridge 3 is mounted on the drum unit 2 and the toner cartridge 3 is located at the second position. The seal member 49 seals between the waste-toner conveyance pipe 7 and the waste-toner accommodation chamber 10 when the toner cartridge 3 is mounted on the drum unit 2 and the toner cartridge 3 is located at the second position. The seal member 49 is formed of a sponge.

The screw 50 is configured to convey the toner in the waste-toner accommodation chamber 10 in the axial direction. The screw 50 is located inside the internal space of the waste-toner accommodation chamber 10. The screw 50 extends in the axial direction.

3.4 Second Shutter 42

The second shutter 42 shown in FIG. 4 is movable between the open position (see FIG. 7) for opening the waste-toner receiving port 11 and the closed position (see FIG. 4) for closing the waste-toner receiving port 11. Specifically, the second shutter 42 is rotatably movable between the open position and the closed position.

The second shutter 42 is located at the closed position when the toner cartridge 3 is located at the first position. Thereby, when the waste-toner conveyance pipe 7 is not connected to the waste-toner accommodation chamber 10, the waste-toner receiving port 11 is closed by the second shutter 42 to prevent leakage of the toner in the waste-toner accommodation chamber 10 through the waste-toner receiving port 11. The second shutter 42 is located at the open position when the toner cartridge 3 is located at the second position. The second shutter 42 moves from the closed position to the open position by making contact with the waste-toner conveyance pipe 7 (see FIG. 7) when the toner cartridge 3 rotatably moves from the first position to the second position. Thereby, by utilizing rotational movement from the first position to the second position of the toner cartridge 3, the second shutter 42 is moved from the closed position to the open position, and the waste-toner conveyance pipe 7 and the waste-toner accommodation chamber 10 are connected. The second shutter 42 extends along the peripheral wall of the waste-toner accommodation chamber 10 in a state where the second shutter 42 is located at the closed position. The second shutter 42 has one end and the other end. In a state where the second shutter 42 is located at the closed position, the one end is located between the other end and the first accommodation chamber 9A. The second shutter 42 has a pivotal axis 42A, a second protrusion 42B and a spring 42C.

The pivotal axis 42A is located at the one end of the second shutter 42. The pivotal axis 42A extends in the axial direction. The second shutter 42 is rotatably movable between the open position and the closed position about the pivotal axis 42A.

The second protrusion 42B protrudes from the other end of the second shutter 42. The second protrusion 42B makes contact with the waste-toner conveyance pipe 7 (see FIG. 7) when the toner cartridge 3 rotatably moves from the first position to the second position. By providing the second protrusion 42B, the second shutter 42 reliably makes contact with the waste-toner conveyance pipe 7. The second shutter 42 moves from the closed position to the open position against the urging force of the spring 42C by contact of the second protrusion 42B with the waste-toner conveyance pipe 7 when the toner cartridge 3 rotatably moves from the first position to the second position. The shape of the second protrusion 42B is not particularly limited. The shape of the second protrusion 42B may be, for example, a column, a cone, a prism, or a pyramid.

The spring 42C urges the second shutter 42 located at the open position toward the closed position. Thereby, the second shutter 42 moves from the open position to the closed position by the urging force of the spring 42C when the toner cartridge 3 rotatably moves from the second position to the first position and the second shutter 42 is separated from the waste-toner conveyance pipe 7. The spring 42 urges the second shutter 42 located at the closed position so as to maintain the second shutter 42 to be in the closed position in a state where the second shutter 42 is not in contact with the waste-toner conveyance pipe 7. Specifically, the spring 42C is a torsion spring.

4. Mounting of Toner Cartridge 3 to Drum Unit 2

Next, the mounting operation of the toner cartridge 3 onto the drum unit 2 will be described with reference to FIG. 6 and FIG. 7.

Figure 6:
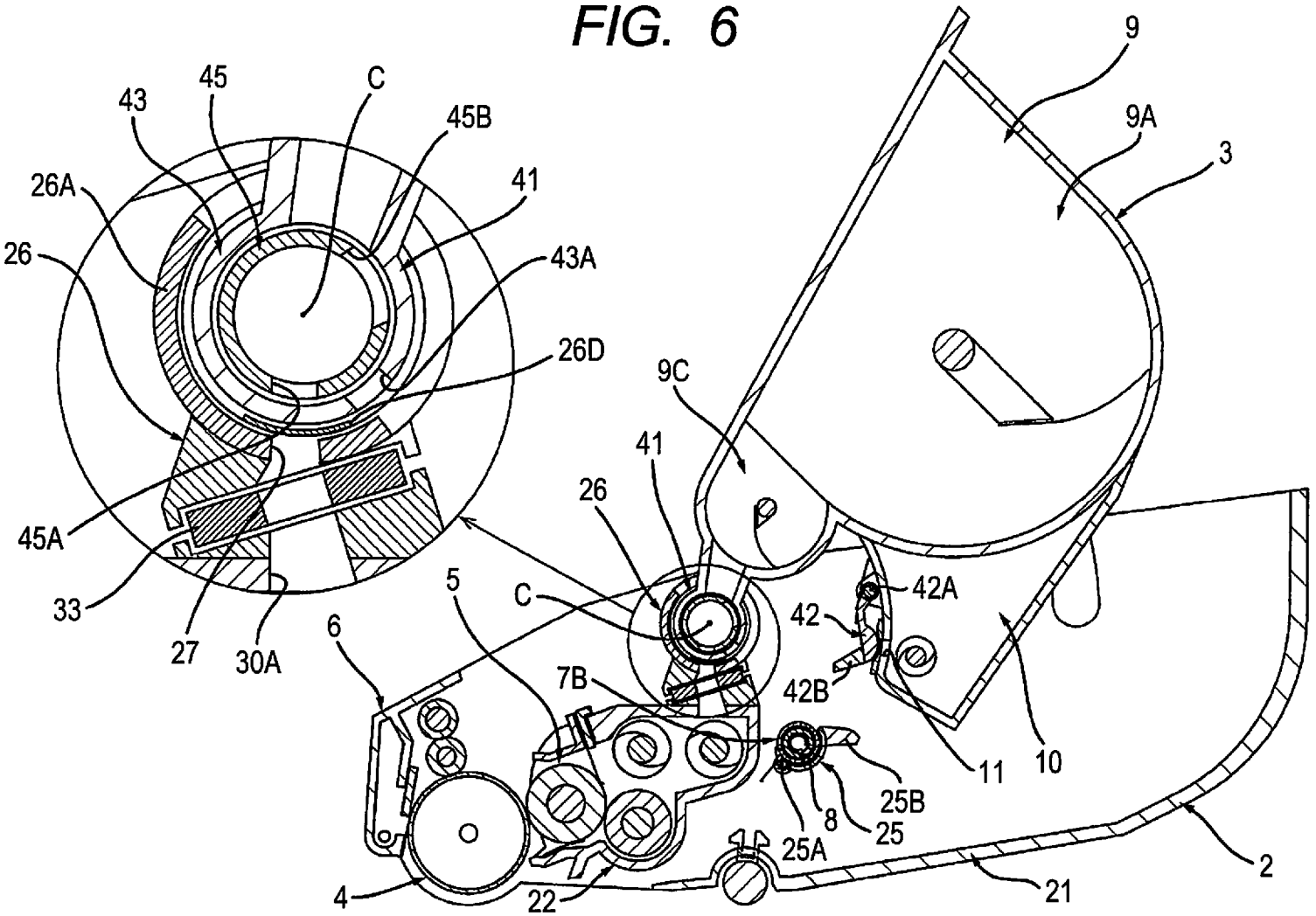
FIG. 6 is an explanatory diagram explaining mounting of the toner cartridge on the drum unit in the first embodiment, and shows a state where the toner cartridge is mounted on the drum unit and the toner cartridge is located at the first position.

In order to mount the toner cartridge 3 onto the drum unit 2, as shown in FIG. 6, a user first fits the connection portion 41 of the toner cartridge 3 to the connection portion 26 of the drum unit 2.

Then, the first boss 47A (see FIG. 5) fits in the first groove 29A (see FIG. 2), the second boss 47B (see FIG. 5) fits in the second groove 29B (see FIG. 2), the third boss 47C (see FIG. 5) fits in the third groove (not shown), and the fourth boss 47D (see FIG. 5) fits in the fourth groove (not shown). Thereby, the shutter 26D, the first rotation portion 26C (see FIG. 2), and the second rotation portion 26C' (see FIG. 3) are fixed to the cylindrical portion 43.

The first rib 48A (see FIG. 5) fits in the groove 28 (see FIG. 2) of the first fixation portion 26B and the second rib 48B (see FIG. 5) fits in the groove of the second fixation portion (not shown). Thereby, the shutter 45 is fixed to the first fixation portion 26B (see FIG. 2) and the second fixation portion (not shown). Thereby, the shutter 45 is not rotatable relative to the drum unit 2.

Next, the user rotatably moves the toner cartridge 3 from the first position to the second position.

Then, the toner cartridge 3 rotatably moves from the first position to the second position around the rotation center C. At this time, the shutter 26D rotatably moves together with the toner cartridge 3 and moves from the closed position to the open position. The shutter 45 relatively moves from the closed position to the open position relative to the cylindrical portion 43 by rotation of the cylindrical portion 43 relative to the shutter 45.

At this time, the first shutter 25 moves from the closed position to the open position by contact of the waste-toner accommodation chamber 10 of the toner cartridge 3 with the first protrusion 25B of the first shutter 25. In addition, the second shutter 42 moves from the closed position to the open position by contact of the second protrusion 42B of the second shutter 42 with the second portion 7B of the waste-toner conveyance pipe 7.

After that, as shown in FIG. 7, when the toner cartridge 3 is located at the second position, the shutter 26D is located at the open position, the shutter 45 is located at the open position, and the internal space of the shutter 45 and the internal space of the developing section 22 communicate with each other through the first opening 45A, the toner discharge port 43A, the toner receiving port 27, and the opening 30A. In addition, the internal space of the shutter 45 and the internal space of the connection pipe 44 communicate with each other through the second opening 45B. In addition, the waste-toner discharge port 8 and the waste-toner receiving port 11 come close to each other, and the internal space of the waste-toner accommodation chamber 10 and the internal space of the waste-toner conveyance pipe 7 communicate with each other through the waste-toner discharge port 8 and the waste-toner receiving port 11.

Thereby, mounting of the toner cartridge 3 onto the drum unit 2 is completed.

5. Operations and Effects

According to the process cartridge 1, as shown in FIG. 6 and FIG. 7, the user rotatably moves the toner cartridge 3 relative to the drum unit 2 to connect the waste-toner conveyance pipe 7 and the waste-toner accommodation chamber 10 in a state where the toner cartridge 3 is mounted on the drum unit 2.

Thus, in a state where the rotation center of the toner cartridge 3 relative to the drum unit 2 is fixed, the waste-toner conveyance pipe 7 and the waste-toner accommodation chamber 10 can be aligned easily.

As a result, the toner cartridge 3 can be mounted easily onto the drum unit 2.

6. Usage Mode of Process Cartridge 1

The usage mode of the process cartridge 1 will be described with reference to FIG. 8.

Figure 8:
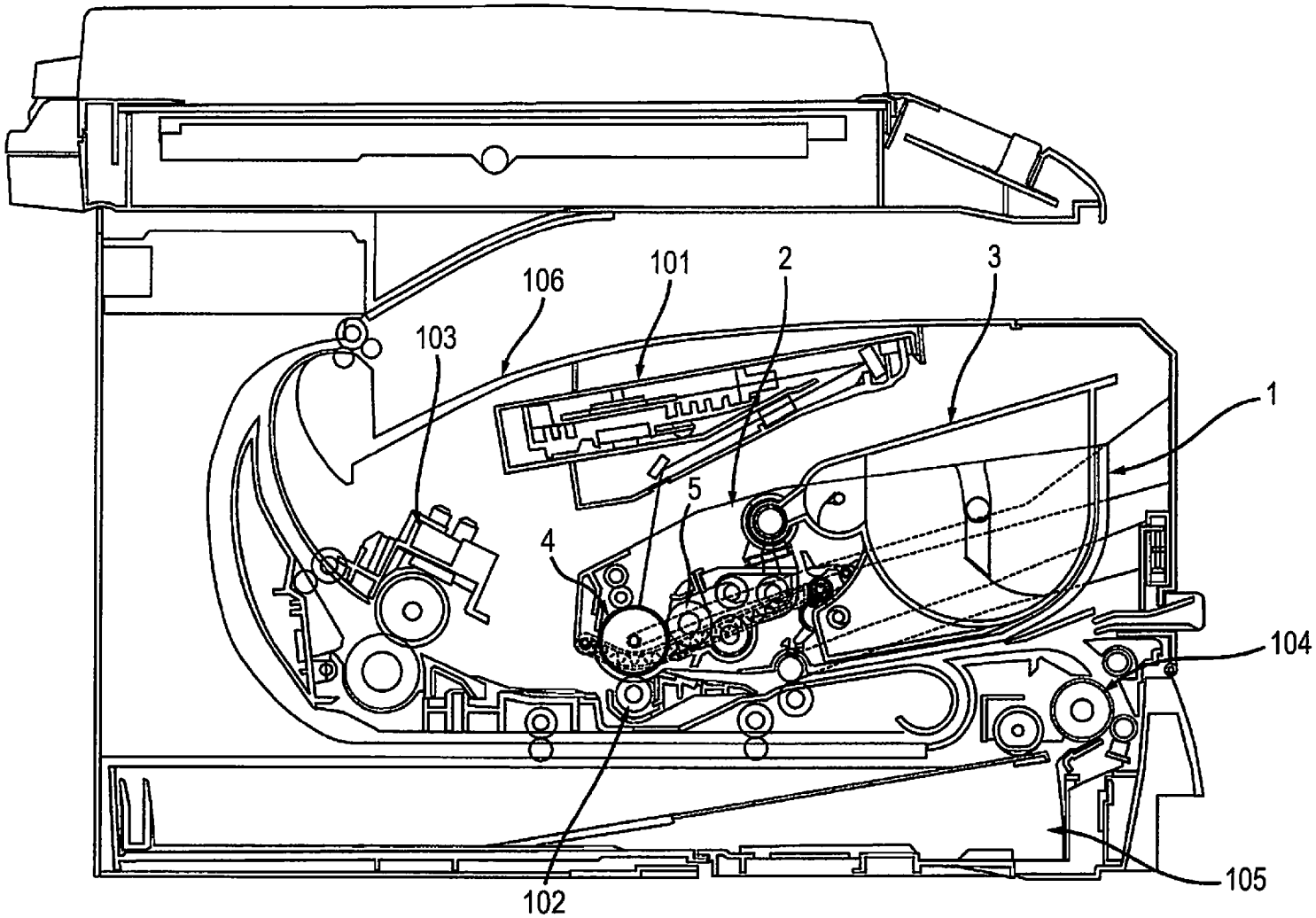
FIG. 8 is an explanatory diagram explaining a usage mode of the process cartridge shown in FIG. 7.

As shown in FIG. 8, the process cartridge 1 described above is mounted on the image forming apparatus 100. The process cartridge 1 is detachably mounted on the image forming apparatus 100.

The image forming apparatus 100 includes a laser scan unit 101, a transfer roller 102, a fixing device 103, a paper feeding section 104, a paper feeding tray 105, and a paper discharge tray 106. The laser scan unit 101 is configured to expose the surface of the photosensitive drum 4. The transfer roller 102 is configured to transfer a toner image formed in the peripheral surface of the photosensitive drum 4 onto a sheet. The transfer roller 102 is in contact with the peripheral surface of the photosensitive drum 4. The fixing device 103 is configured to heat and apply pressure to the sheet having the transferred toner image to fix the toner image onto the sheet. The paper feeding section 104 is configured to feed the sheet in the sheet feeding tray 105 to between the photosensitive drum 4 and the transfer roller 102. The paper feeding tray 105 is configured to accommodate sheets. The sheet that has passed the fixing device 103 is discharged onto the paper discharge tray 106.

7. Second Embodiment

A second embodiment will be described while referring to FIG. 9A to FIG. 11B wherein like parts and components are designated by the same reference numerals to avoid duplicating description.

7.1 Connection Portion 61 of Drum Unit 2

Figure 9A:
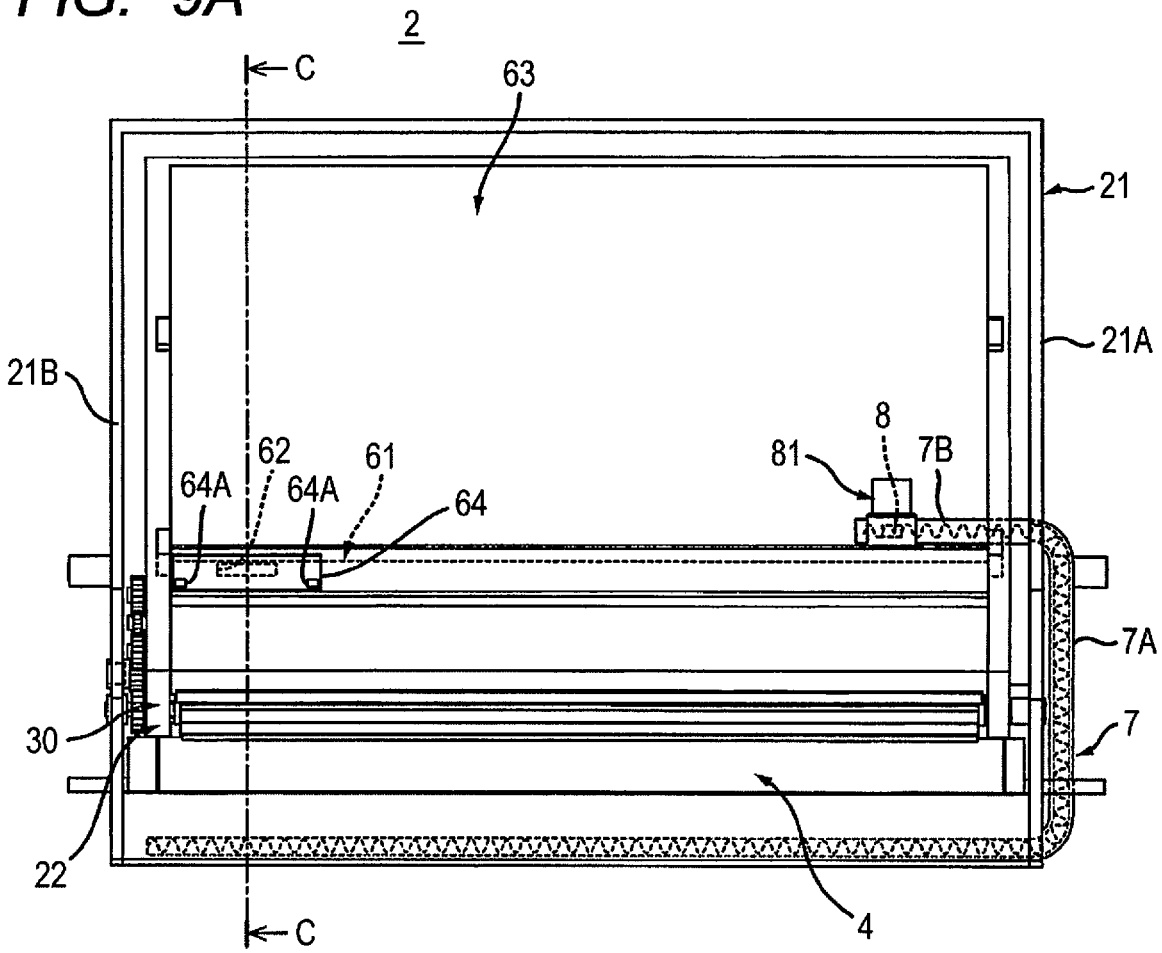
FIG. 9A is a plan view showing a drum unit of a second embodiment.

In the first embodiment described above, the connection portion 26 having the toner receiving port 27 is located closer to the first side plate 21A than to the second side plate 21B in the axial direction. However, as shown in FIG. 9A, a connection portion 61 having a toner receiving port 62 may be located closer to the second side plate 21B than to the first side plate 21A in the axial direction. That is, the toner receiving port 62 may be located closer to the second side plate 21B than to the first side plate 21A in the axial direction. The connection portion 61 includes a shutter 64 that is movable between the open position (see FIG. 10B) for opening the toner receiving port 62 and the closed position (see FIG. 10A) for closing the toner receiving port 62. The shutter 64 has a hole 64A. A protrusion 73B of a cylindrical portion 73 described later fits in the hole 64A in a state where the toner cartridge 3 is mounted on the drum unit 2 and the toner cartridge 3 is located at the first position.

Figure 10A:
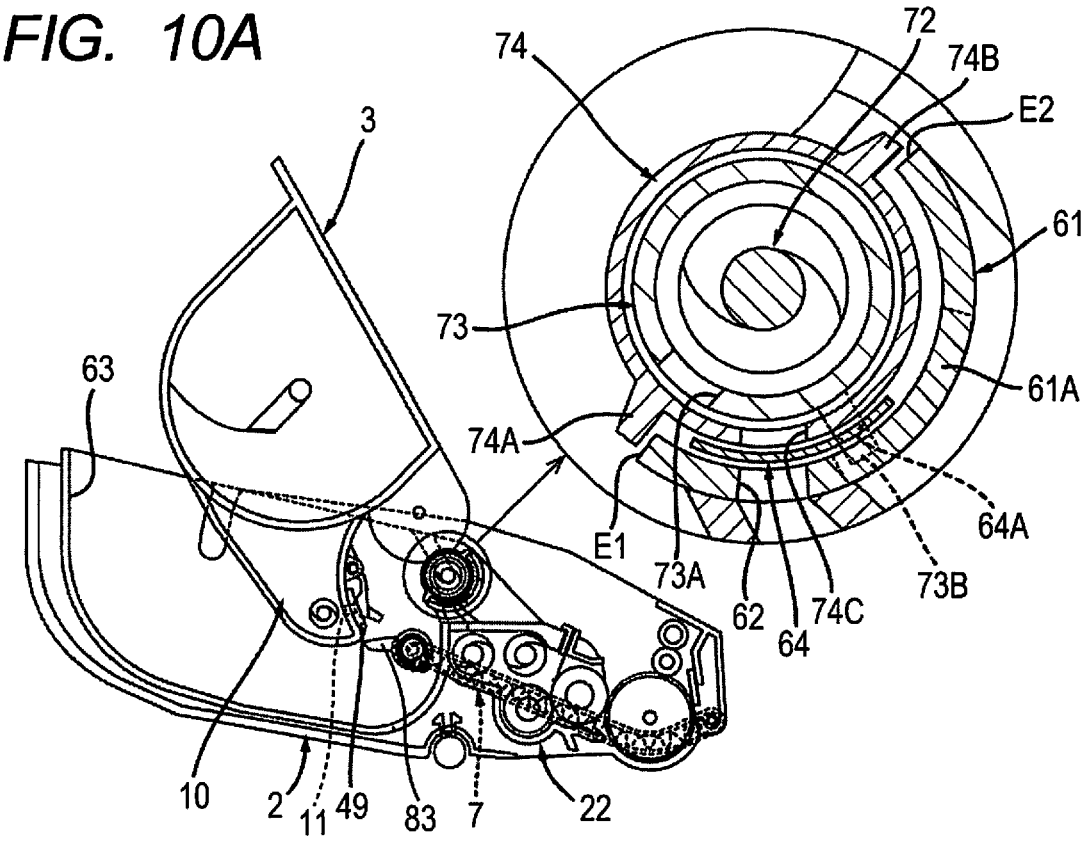
FIG. 10A is an explanatory diagram explaining mounting of the toner cartridge to the drum unit in the second embodiment, and shows a state where the toner cartridge is mounted on the drum unit and the toner cartridge is located at a first position.
Figure 10B:
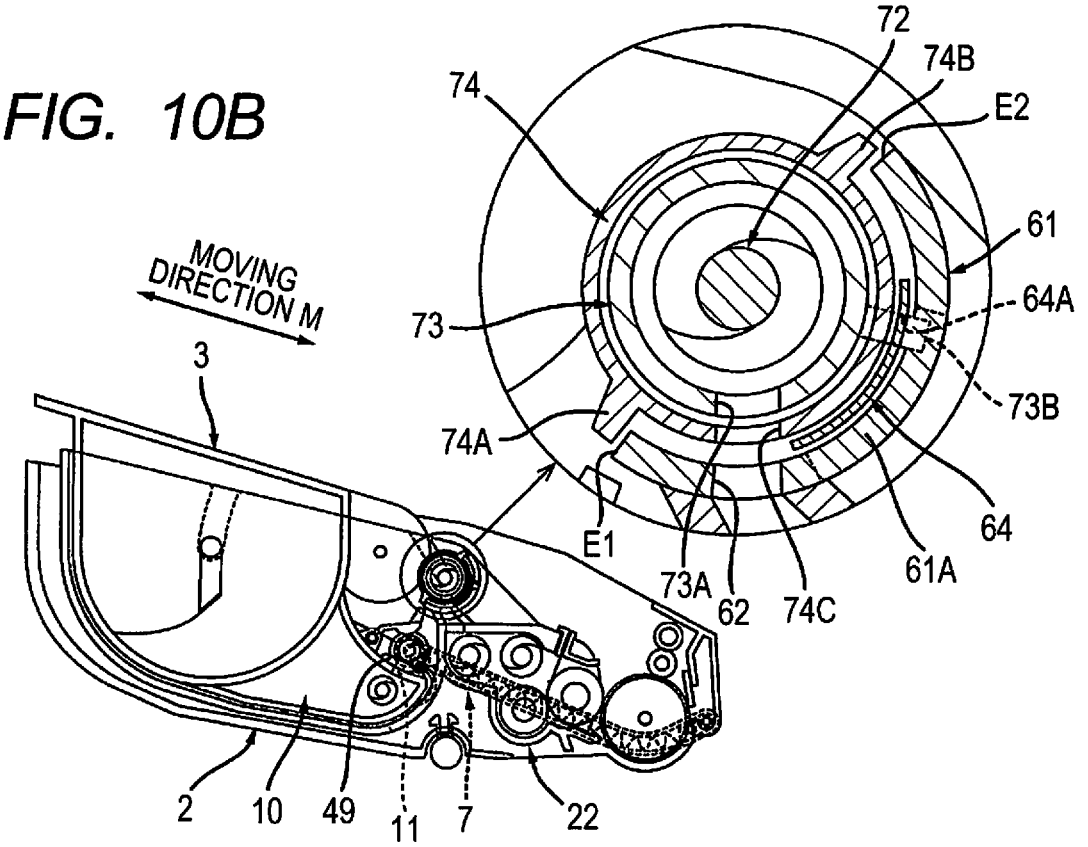
FIG. 10B is an explanatory diagram explaining mounting of the toner cartridge on the drum unit in the second embodiment, together with FIG. 10A, and shows a state where the toner cartridge is mounted on the drum unit and the toner cartridge is located at a second position.

In the first embodiment described above, the connection portion 26 is provided at the frame 21. However, as shown in FIG. 9A, the connection portion 61 may be provided at the developing section 22. That is, the toner receiving port 62 may be provided at the developing section 22. In this case, the developing frame 30 includes a mounting part 63 on which the toner cartridge 3 is mounted. As shown in FIG. 10B, the mounting part 63 is movable, together with the developing section 22, relative to the photosensitive drum 4 and the frame 21. That is, in a state where the toner cartridge 3 is mounted on the drum unit 2, the toner cartridge 3 is not movable relative to the developing section 22 and is movable, together with the developing section 22, relative to the photosensitive drum 4 and the frame 21.

That is, the toner cartridge 3 is movable, together with the developing section 22, relative to the waste-toner conveyance pipe 7. The moving distance of the toner cartridge 3 is approximately 1 mm (millimeter). Therefore, when the toner cartridge 3 moves relative to the waste-toner conveyance pipe 7, the waste-toner receiving port 11 moves relative to the waste-toner discharge port 8 for approximately 1 mm in the moving direction M. When the toner cartridge 3 moves relative to the waste-toner conveyance pipe 7, the seal member 49 (see FIG. 10B) formed of a sponge deforms in a state of sealing between the waste-toner conveyance pipe 7 and the waste-toner accommodation chamber 10 by following the movement of the toner cartridge 3. Thereby, when the toner cartridge 3 moves relative to the waste-toner conveyance pipe 7, toner leakage from a gap between the waste-toner discharge port 8 and the waste-toner receiving port 11 is prevented.

The waste-toner discharge port 8 and the waste-toner receiving port 11 have a side (edge) extending in the moving direction M. Therefore, the movement of the developing section 22 and the toner cartridge 3 is not inhibited. In other words, the direction in which the waste-toner discharge port 8 and the waste-toner receiving port 11 overlap is almost perpendicular to the moving direction M. Therefore, movement of the developing section 22 and the toner cartridge 3 is not inhibited.

7.2 Connection Portion 71 of Toner Cartridge 3

Figure 9B:
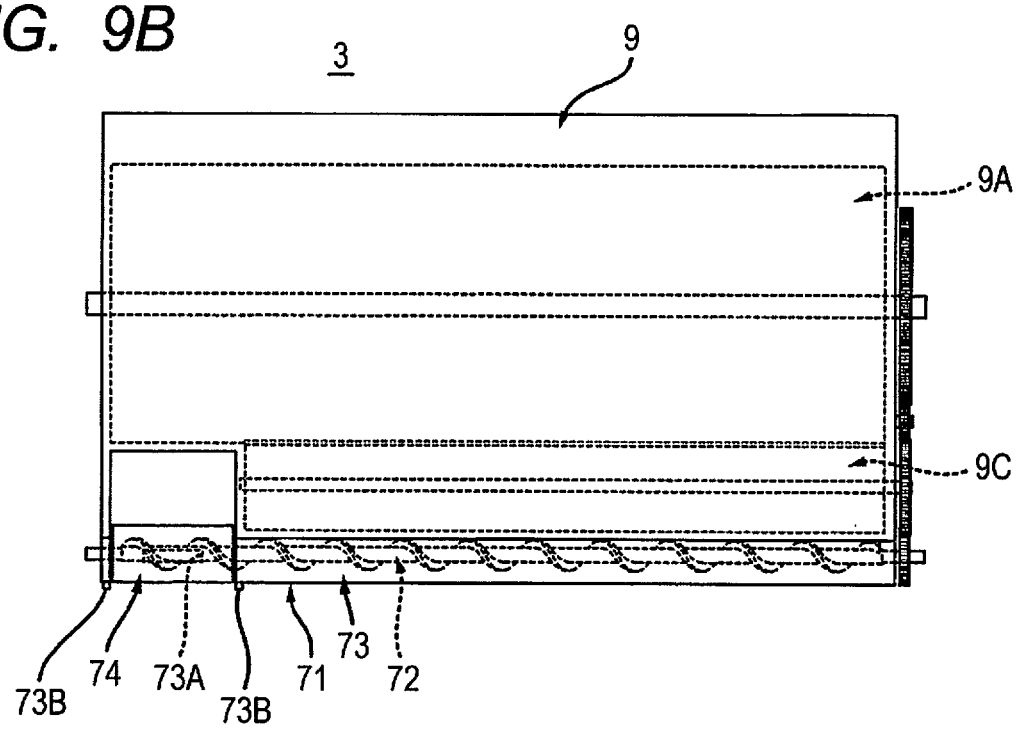
FIG. 9B is a plan view showing a toner cartridge of the second embodiment.

As shown in FIG. 9B, a connection portion 71 of the second embodiment has the cylindrical portion 73, a shutter 74, and an auger screw 72.

7.2.1 Cylindrical Portion 73

The cylindrical portion 73 extends in the axial direction. The cylindrical portion 73 connects to a second accommodation chamber 9C. The cylindrical portion 73 has a toner discharge port 73A. The toner discharge port 73A is located closer to the second side plate 21B than to the first side plate 21A in the axial direction in a state where the toner cartridge 3 is mounted on the drum unit 2. As shown in FIG. 10A, the cylindrical portion 73 has the protrusion 73B. The protrusion 73B fits in the hole 64A of the shutter 64 in a state where the toner cartridge 3 is mounted on the drum unit 2 and the toner cartridge 3 is located at the first position. Thereby, in a state where the toner cartridge 3 is mounted on the drum unit 2 and the toner cartridge 3 is located at the first position, the shutter 64 is fixed to the cylindrical portion 73.

7.2.2 Shutter 74

As shown in FIG. 10A and FIG. 10B, the shutter 74 is movable relative to the cylindrical portion 73, between the open position (see FIG. 10B) for opening the toner discharge port 73A and the closed position (see FIG. 10A) for closing the toner discharge port 73A. Specifically, the shutter 74 is rotatable relative to the cylindrical portion 73 between the open position and the closed position. The shutter 74 is located closer to the second side plate 21B than to the first side plate 21A in the axial direction in a state where the toner cartridge 3 is mounted on the drum unit 2. The shutter 74 is located outside the cylindrical portion 73 in the radial direction of the cylindrical portion 73. The shutter 74 extends in the axial direction. The shutter 74 has a cylindrical shape. The shutter 74 has a protrusion 74A, a protrusion 74B, and an opening 74C.

The protrusion 74A makes contact with one end E1 of an arc portion 61A of the connection portion 61 when the toner cartridge 3 is mounted on the drum unit 2 and the toner cartridge 3 moves from the first position to the second position. Thereby, when the toner cartridge 3 is mounted on the drum unit 2 and the toner cartridge 3 moves from the first position to the second position, the shutter 74 is fixed to the connection portion 61.

The protrusion 74B makes contact with an other end E2 of the arc portion 61A of the connection portion 61 when the toner cartridge 3 is mounted on the drum unit 2 and the toner cartridge 3 moves from the second position to the first position. Thereby, when the toner cartridge 3 is mounted on the drum unit 2 and the toner cartridge 3 moves from the second position to the first position, the shutter 74 is fixed to the connection portion 61.

The opening 74C overlaps the toner discharge port 73A in the radial direction of the cylindrical portion 73 when the shutter 74 is located at the open position. Thereby, the internal space of the cylindrical portion 73 and the internal space of the developing section 22 communicate with each other through the toner discharge port 73A, the opening 74C, and the toner receiving port 62. When the shutter 74 is located at the closed position, the opening 74C is located at a different position from the toner discharge port 73A in the rotation direction of the shutter 74. Thereby, when the shutter 74 is located at the closed position, the internal space of the cylindrical portion 73 and the internal space of the developing section 22 are not in communication with each other. When the shutter 74 is located at the closed position, the inner circumferential surface of the shutter 74 closes the toner discharge port 73A.

7.2.3 Auger Screw 72

As shown in FIG. 9B, the auger screw 72 conveys, toward the toner discharge port 73A, the toner that has been conveyed to the cylindrical portion 73 by the second agitator 9D. The auger screw 72 is located inside the cylindrical portion 73. The auger screw 72 extends in the axial direction. The auger screw 72 extends at least to the toner discharge port 73A.

7.3 First Shutter 81

Figure 11A:
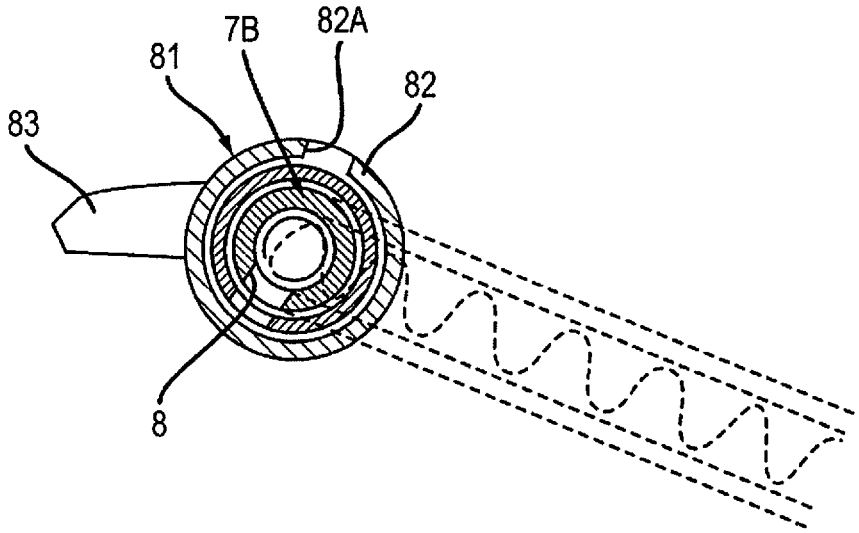
FIG. 11A is an explanatory diagram explaining a first shutter in the second embodiment, and shows a state where the first shutter is located at a closed position.
Figure 11B:
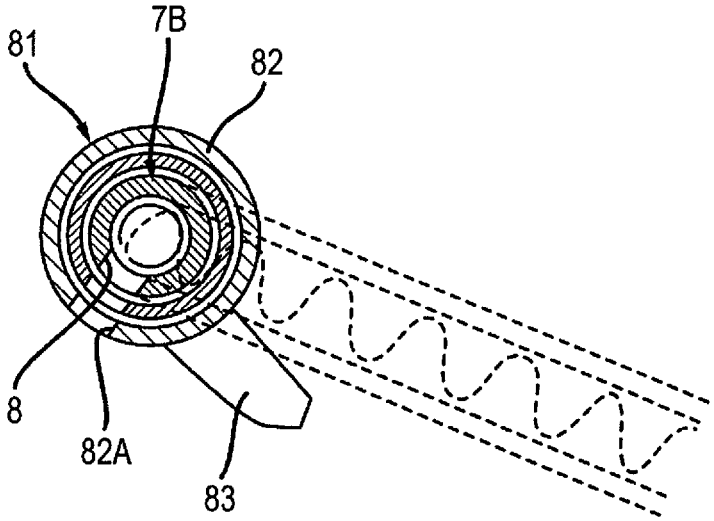
FIG. 11B is an explanatory diagram explaining the first shutter in the second embodiment, together with FIG. 11A, and shows a state where the first shutter is located at an open position.

As shown in FIG. 11A and FIG. 11B, a first shutter 81 of the second embodiment is rotatable between the open position (see FIG. 11B) for opening the waste-toner discharge port 8 and the closed position (see FIG. 11A) for closing the waste-toner discharge port 8. The first shutter 81 has a tubular portion 82 and a first protrusion 83.

The tubular portion 82 is located outside the second portion 7B in the radial direction of the second portion 7B of the waste-toner conveyance pipe 7. The tubular portion 82 extends in the axial direction. The tubular portion 82 has a cylindrical shape. The tubular portion 82 has an opening 82A.

The opening 82A overlaps the waste-toner discharge port 8 in the radial direction of the second portion 7B when the first shutter 81 is located at the open position. Thereby, in a state where the toner cartridge 3 is mounted on the drum unit 2 and the toner cartridge 3 is located at the second position, the internal space of the waste-toner conveyance pipe 7 and the internal space of the waste-toner accommodation chamber 10 communicate with each other through the waste-toner discharge port 8 and the opening 82A.

When the first shutter 81 is located at the closed position, the opening 82A is located at a different position from the waste-toner discharge port 8 in the rotation direction of the first shutter 81. Thereby, when the toner cartridge 3 moves from the second position to the first position, the internal space of the waste-toner conveyance pipe 7 and the internal space of the waste-toner accommodation chamber 10 do not communicate with each other. When the first shutter 81 is located at the closed position, the inner circumferential surface of the first shutter 81 closes the waste-toner discharge port 8.

The first protrusion 83 protrudes from the tubular portion 82. The first protrusion 83 makes contact with the toner cartridge 3 when the toner cartridge 3 rotatably moves from the first position to the second position. The first shutter 81 moves from the closed position to the open position by contact of the first protrusion 83 with the toner cartridge 3 when the toner cartridge 3 rotatably moves from the first position to the second position. The shape of the first protrusion 83 is not particularly limited. The shape of the first protrusion 83 may be, for example, a column, a cone, a prism, or a pyramid.

While the disclosure has been described in detail with reference to the above aspects thereof, it would be apparent to those skilled in the art that various changes and modifications may be made therein without departing from the scope of the claims.

What is claimed is:

1. A process cartridge comprising:
a drum unit comprising:
a photosensitive drum being rotatable about a drum axis extending in an axial direction;
a frame for supporting the photosensitive drum, the frame comprising:
a first side plate;
a second side plate; and
a first connection portion located between the first side plate and the second side plate in the axial direction,
the first connection portion comprising:
an arc wall having a toner receiving port; and
a shutter being movable between
an open position in which the toner receiving port is opened and
a closed position in which the toner receiving port is closed;
a developing section comprising:
a developing roller being rotatable about a developing roller axis extending in the axial direction;
a developing frame for supporting the developing roller, the developing frame having an opening; and
a seal member sealing between the first connection portion and the developing frame, the developing section being movable relative to the photosensitive drum; and
a toner cartridge attachable to and detachable from the drum unit, the toner cartridge comprising:
a toner accommodating chamber for accommodating toner; and
a second connection portion;
wherein, when the toner cartridge is attached to the drum unit, the second connection portion is connected to the first connection portion.

2. The process cartridge according to claim 1,
wherein the second connection portion has a toner discharge port; and
wherein the toner accommodation chamber comprises:
a first accommodation chamber;
a second accommodation chamber being in communication with the first accommodation chamber and being in communication with the toner discharge port;
a first agitator disposed in the first accommodation chamber for conveying toner in the first accommodation chamber to the second accommodation chamber; and
a second agitator disposed in the second accommodation chamber for conveying toner in the second accommodation chamber to the toner discharge port.

3. The process cartridge according to claim 1,
wherein the drum unit further comprises:
a drum cleaner configured to remove waste toner from the photosensitive drum; and
a waste-toner conveyance pipe having a waste-toner discharge port, the waste-toner conveyance pipe being configured to convey waste toner from the drum cleaner to the waste-toner discharge port;
wherein the toner cartridge further comprises a waste-toner accommodation chamber having a waste-toner receiving port; and
wherein, in a state where the toner cartridge is attached to the drum unit, the waste-toner receiving port on the waste-toner accommodation chamber receives waste toner from the waste-toner discharge port on the waste-toner conveyance pipe.

4. The process cartridge according to claim 1,
wherein the second connection portion comprises a cylindrical portion having a toner discharge port;
wherein, when the toner cartridge is attached to the drum unit, the arc wall receives the cylindrical portion;
wherein, when the toner cartridge is attached to the drum unit, the toner cartridge is rotatable between a first position and a second position;
wherein, when the toner cartridge rotates between the first position and the second position, the cylindrical portion moves along the arc wall;
wherein the shutter is located at the closed position when the toner cartridge is located at the first position; and
wherein the shutter is located at the open position when the toner cartridge is located at the second position.

5. The process cartridge according to claim 1,
wherein the frame movably supports the developing frame;
wherein the developing frame is configured to move relative to the frame and the photosensitive drum; and
wherein the seal member is interposed between the first connection portion and the developing frame; and
wherein the seal member seals between the first connection portion and the developing frame while allowing passage of toner from the toner receiving port on the arc wall to the opening on the developing frame.

6. The process cartridge according to claim 2,
wherein a volume of the first accommodation chamber is larger than a volume of the second accommodation chamber.

7. The process cartridge according to claim 1, wherein the frame further comprises a connecting cylinder having a cylindrical shape; and wherein the first connecting portion is disposed on the connecting cylinder.

8. The process cartridge according to claim 3, wherein the second connection portion has a toner discharge port;

wherein the toner accommodation chamber comprises:

a first accommodation chamber; and a second accommodation chamber being in communication with the first accommodation chamber and being in communication with the toner discharge port; and wherein, when the toner cartridge is attached to the drum unit, the waste-toner accommodation chamber is located between the developing frame and the first accommodation chamber.

* * * * *